US006217036B1

(12) United States Patent
Rowledge

(10) Patent No.: US 6,217,036 B1
(45) Date of Patent: Apr. 17, 2001

(54) FLEXIBLE FOOTBED SKATE

(76) Inventor: Darrel Rowledge, 2428 Capital Hill Crescent, N.W., Calgary (CA), T2M 4M2

( * ) Notice: Subject to any disclaimer, the term of this patent is extended or adjusted under 35 U.S.C. 154(b) by 0 days.

(21) Appl. No.: 09/403,703

(22) PCT Filed: Apr. 22, 1998

(86) PCT No.: PCT/CA98/00370

§ 371 Date: Jan. 24, 2000

§ 102(e) Date: Jan. 24, 2000

(87) PCT Pub. No.: WO98/47576

PCT Pub. Date: Oct. 29, 1998

(30) Foreign Application Priority Data

Apr. 22, 1997 (CA) ..... 2203331

(51) Int. Cl.[7] ..... A63C 1/26

(52) U.S. Cl. ..... 280/11.15; 36/115; 280/11.18

(58) Field of Search ..... 280/11.12, 600, 280/11.14, 11.15, 11.16, 11.17, 11.18, 7.12, 7.13, 844, 11.3, 7.14, 7.15, 11.221, 11.224, 11.231; 36/115

(56) References Cited

U.S. PATENT DOCUMENTS

| | | | | |
|---|---|---|---|---|
| 31,797 | * | 3/1861 | Gibson | 280/11.15 |
| 454,040 | * | 6/1891 | Freese | 280/11.15 |
| 467,047 | * | 1/1892 | McQuown | 280/11.15 |
| 619,327 | * | 2/1899 | Miner | 280/11.15 |
| 1,228,544 | * | 6/1917 | Falsterm et al. | 280/11.15 |
| 1,603,588 | | 10/1926 | Eberle . | |
| 1,751,692 | * | 3/1930 | Fruhbeis | 280/11.15 |
| 2,093,915 | | 9/1937 | Klevstad | 208/167 |

(List continued on next page.)

FOREIGN PATENT DOCUMENTS

| | | | | |
|---|---|---|---|---|
| 2151210 | | 12/1995 | (CA) . | |
| 2155444 | * | 2/1997 | (CA) . | |
| 488 768 | | 12/1929 | (DE) . | |
| 3542251 | * | 6/1987 | (DE) . | |
| 0 774 282 A1 | | 11/1995 | (EP) | A63C/17/06 |
| 0 686 412 A2 | | 12/1995 | (EP) | A63C/17/00 |
| 0 778 058 | | 12/1995 | (EP) | A63C/17/06 |
| 956887 | * | 11/1999 | (EP) . | |
| 2659534 | * | 6/1987 | (FR) . | |
| 8 602 796 | | 6/1988 | (NL) | A63C/1/28 |
| WO 97/3263 | | 9/1997 | (WO) | A63C/17/06 |

OTHER PUBLICATIONS

Jan Van Ingen Schenau, G.J., et al, "A new skate allowing powerful plantar flexions improves performance", Med. Sci. Sports Exerv., vol. 28, No. 4, pp. 531–535, 1996.

Hoshizaki, T.B., et al., "Kinematic Analysis of the Talocrural and Subtalar Joints During the Hockey Skating Stride", Safety in Ice Hockey, ASTM STP 1050, C.R. Castaldi and E.F. Hoerner, Eds., American Society for Testing and Materials, Philadelphia, 1989, pp. 141–149.

*Primary Examiner*—Brian L. Johnson
*Assistant Examiner*—Bryan Fischmann
(74) *Attorney, Agent, or Firm*—Harness, Dickey & Pierce, P.L.C.

(57) ABSTRACT

A skate includes a boot having an upper portion for supporting the lower leg, ankle and foot, and a footbed for supporting the sole of a foot. The footbed includes anterior and posterior portions as well as a hinge located between the anterior and posterior portions. The hinge permits upward pivotal movement of the anterior and posterior portions of the footbed relative to each other. The skate also includes a blade, which may include an ice skating blade or wheels. The blade has anterior and posterior portions depending rigidly from the anterior and posterior portions of the footbed respectively.

17 Claims, 27 Drawing Sheets

U.S. PATENT DOCUMENTS

| | | | | |
|---|---|---|---|---|
| 4,408,403 | * | 10/1983 | Martin | 36/115 |
| 4,655,465 | | 4/1987 | Schaeffer | 280/11.12 |
| 4,724,627 | * | 2/1988 | Sisco . | |
| 4,839,972 | | 6/1989 | Pack et al. | 36/117 |
| 5,446,976 | | 9/1995 | Donnadieu et al. | 36/117 |
| 5,498,033 | | 3/1996 | Hoshizaki et al. | 280/841 |
| 5,540,455 | | 7/1996 | Chambers | 280/87.042 |
| 5,595,392 | * | 1/1997 | Casillas | 280/7.13 |
| 5,794,362 | * | 8/1998 | Polk, III et al. | 36/115 X |
| 5,884,420 | * | 3/1999 | Donnadieu | 36/115 X |
| 5,926,979 | * | 7/1999 | Borel | 36/115 |

* cited by examiner

FLEXIBLE FOOTBED SKATE

FIELD OF INVENTION

The present invention relates to skates, and particularly to skates having a flexible or hingeable footbed, blade or wheel means and a flexible boot.

BACKGROUND OF THE INVENTION

Conventional skates, whether they are ice skates or in-line (wheeled) skates, generally include a boot and a blade or wheels rigidly attached to the bottom of the boot by way of a frame (i.e. a blade frame or a wheel frame, as the case may be). The boot includes an upper portion for supporting a skater's ankle and foot, and a substantially flat footbed or sole for supporting the sole of a skater's foot. The upper portion of the boot, while quite rigid, allows a small amount of forward flex (i.e. forward ankle pivot, moving a skater's lower knee forward relative to the footbed), without which a skater would not be able to bend his or her knees significantly without falling backwards. The conventional footbed is designed and constructed to be rigid, holding the sole of the foot in a single plane. The blade of a conventional ice skate is usually constructed of a single piece of rigid stainless steel that is rigidly attached by way of a blade frame to the bottom of the footbed. Similarly, conventional in-line skates include a series of wheels aligned in a fixed plane and rigidly attached by way of a wheel frame to the bottom of the footbed. Just as there is no significant movement of a rigid ice skate blade relative to the footbed, there is no significant movement of in-line skate wheels relative to the footbed.

When in use, conventional skates hold a skater's foot stationary relative to the footbed. As a result, the fulcrum for a skater's calf muscle extension moves from its usual point at the ball of the foot to the tip of the blade in the case of an ice skate, or to the bottom of the front wheel in the case of an in-line skate. As well, conventional skates usually combine a significant heel lift (required to put the skater into a better skating posture), and a stiff and relatively inflexible boot, which first reduces the range of flex for calf muscle extension, and then severely restricts even that range. Thus, the design and rigidity of conventional skates leads to a number of limitations in skating technique and efficiency. Several biomechanical inefficiencies result. One biomechanical inefficiency relates to the rigidity with which the skater's foot and ankle are held, thereby disallowing the skater from taking full advantage of the strength of his or her calf muscle compared, for example, with the power that can be generated by a sprinter wearing running shoes. Another inefficiency relates to the fact that the range of movement possible for a skater's calf muscle extension is both limited and restricted. Another inefficiency relates to the requirement of a skater's calf muscle extension being translated through one fulcral point throughout any and all calf muscle extension. Another inefficiency results from the positioning of that fulcral point (i.e., anterior; at the tip of the blade or the bottom of the front wheel) which presents distinct disadvantages in any initial calf muscle extension.

SUMMARY OF THE INVENTION

A first object of the present invention is to provide an improved skate.

A second object of the invention is to provide a more comfortable skate, designed to accommodate and facilitate the natural anatomy and physiology of the foot.

A third object of the present invention is to provide a skate that is more physically efficient than conventional skates in certain circumstances.

A fourth object of the present invention is to provide a skate that is more biomechanically efficient than conventional skates in certain circumstances.

A fifth object of the invention is to provide a skate that offers greater flexibility, and a greater range of flexibility, to allow optimal thrust from calf muscle extension.

A sixth object of the invention is to provide a skate that allows the fulcrum for a skater's initial calf muscle extension to function near the ball of a skater's foot.

A seventh object of the invention is to provide a skate that allows the fulcrum for a skater's final calf muscle extension to function at the tip of the blade or bottom of the front wheel, and to allow this fulcral point to be extended further forward than is practical with conventional skates.

According to the present invention, there is provided a skate comprising: a boot comprising a footbed for supporting the sole of a foot and an upper portion for supporting a lower leg; the footbed comprising anterior and posterior portions and first hinge means therebetween to permit upward pivotal movement of the anterior and posterior portions of the footbed relative to each other between first and second positions; and the upper portion comprising anterior and posterior portions movable relative to each other, the anterior portion of the upper portion of the boot being rigidly attached to the anterior portion of the footbed, and the posterior portion of the upper portion of the boot being rigidly attached to the posterior portion of the footbed; and blade means comprising anterior and posterior portions depending rigidly from the anterior and posterior portions of the footbed respectively.

According to the present invention, there is further provided a skate comprising: a boot comprising a footbed for supporting the sole of a foot and an upper portion for supporting a lower leg; the upper portion comprising a cuff portion, a heel portion, at least one central portion overlapping both the cuff and heel portions, and second hinge means attached to the cuff, heel and central portions to permit backward and forward pivotal movement of the cuff, heel and central portions relative to each other; and blade means depending rigidly from footbed.

According to the present invention, there is further provided a skate comprising: a boot comprising a footbed for supporting the sole of a foot and an upper portion for supporting a lower leg; the footbed comprising anterior and posterior portions and first hinge means therebetween to permit upward pivotal movement of the anterior and posterior portions of the footbed relative to each other between first and second positions; and the upper portion comprising anterior and posterior portions movable relative to each other, the anterior portion of the upper portion of the boot being rigidly attached to the anterior portion of the footbed, and the posterior portion of the boot being rigidly attached to the posterior portion of the footbed; the posterior portion of the upper portion of the boot comprising a cuff portion, a heel portion, at least one central portion overlapping both the cuff and heel portions, and second hinge means attached to the cuff, heel and central portions to permit backward and forward pivotal movement of the cuff, heel and central portions relative to each other; and blade means comprising anterior and posterior portions depending rigidly from the anterior and posterior portions of the footbed respectively.

Other advantages, objects and features of the present invention will be readily apparent to those skilled in the art from a review of the following detailed descriptions of a preferred embodiment in conjunction with the accompanying drawings and claims.

BRIEF DESCRIPTION OF THE DRAWINGS

The embodiments of the invention will now be described with reference to the accompanying drawings, in which.

Similar references are used in different Figures to denote similar components.

DETAILED DESCRIPTION OF THE INVENTION

Figure 1:
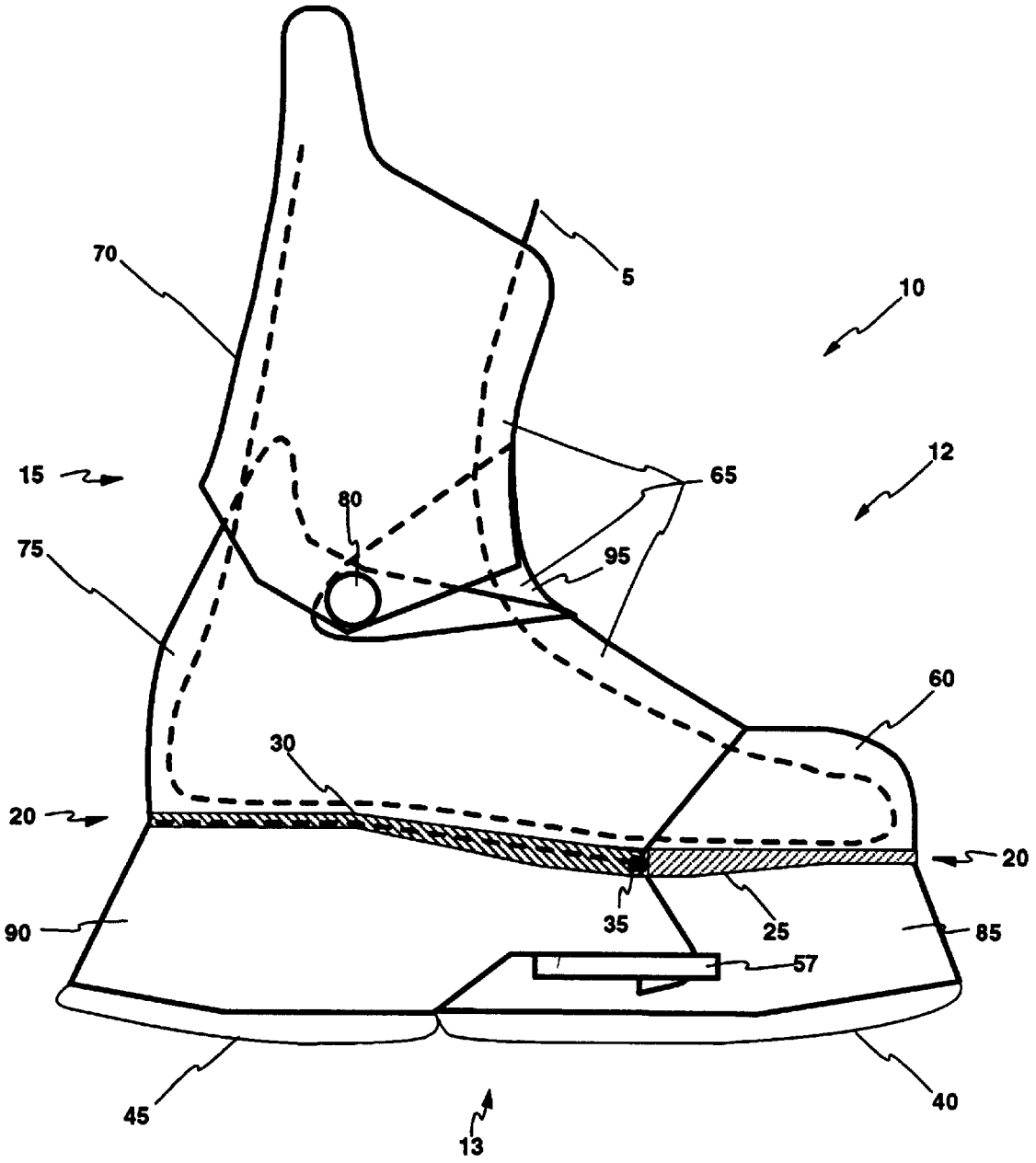
FIG. 1 is a side elevation view of one embodiment of the present invention with the blade means in the aligned horizontal position.

Referring to FIG. 1, there is shown a skater's foot and ankle 5 on which is worn an ice skate 10 according to the present invention. An ice skate 10 includes a boot 12 and an ice skate blade means 13.

The boot 12 includes an upper portion 15 for supporting the lower leg, ankle and foot 5, and a footbed 20 for supporting the sole of the skater's foot.

The footbed 20 includes an anterior portion 25 and a posterior portion 30. A first hinge 35 is attached between the anterior portion 25 of the footbed 20 and the posterior portion 30 of the footbed 20. The first hinge 35 may be variously constructed. For example, it may be a conventional door-type hinge having two separate rigid components and a pin. Alternatively, the first hinge 35 may simply be a flexible zone of the footbed 20. Alternatively, the first hinge 35 may be a complex hinge. The first hinge 35 permits upward pivotal movement of the anterior portion 25 of the footbed 20 and the posterior portion 30 of the footbed 20 relative to each other between a first position, illustrated in FIG. 1, and a second position, illustrated in FIGS. 2 and 3.

The ice skate blade means 13 includes an anterior portion 40 and a posterior portion 45. The anterior portion 40 of the ice skate blade means 13 is rigidly attached to the anterior portion 25 of the footbed 20 by way of a connective means 85. The posterior portion 45 of the ice skate blade means 13 is rigidly attached to the posterior portion 30 of the footbed 20 by way of a connective means 90.

Figure 6:
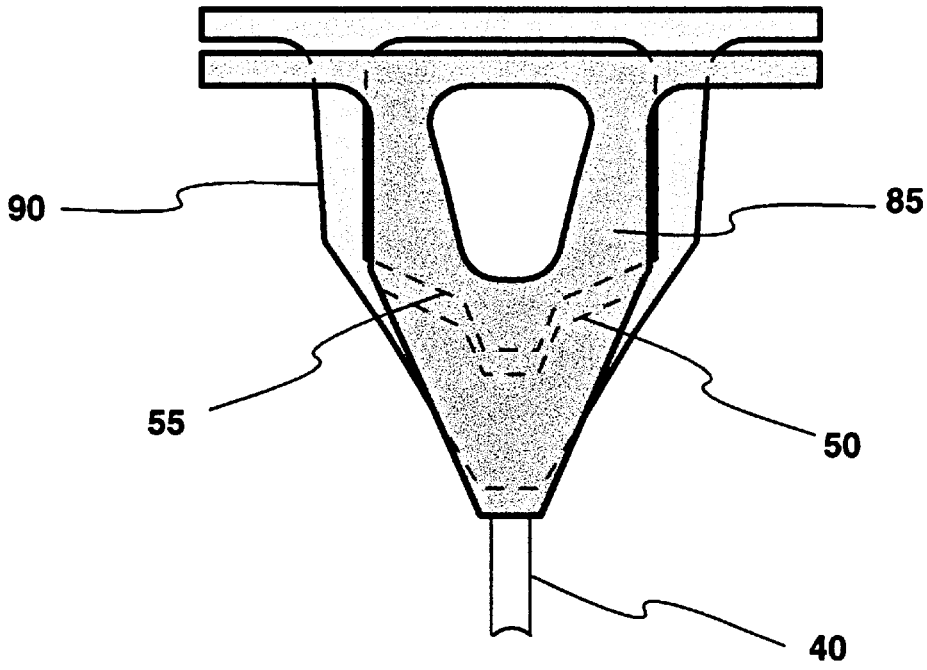
FIG. 6 is a cross-sectional front elevation view of the overlapping connective means in an "anterior inside" configuration.
Figure 7:
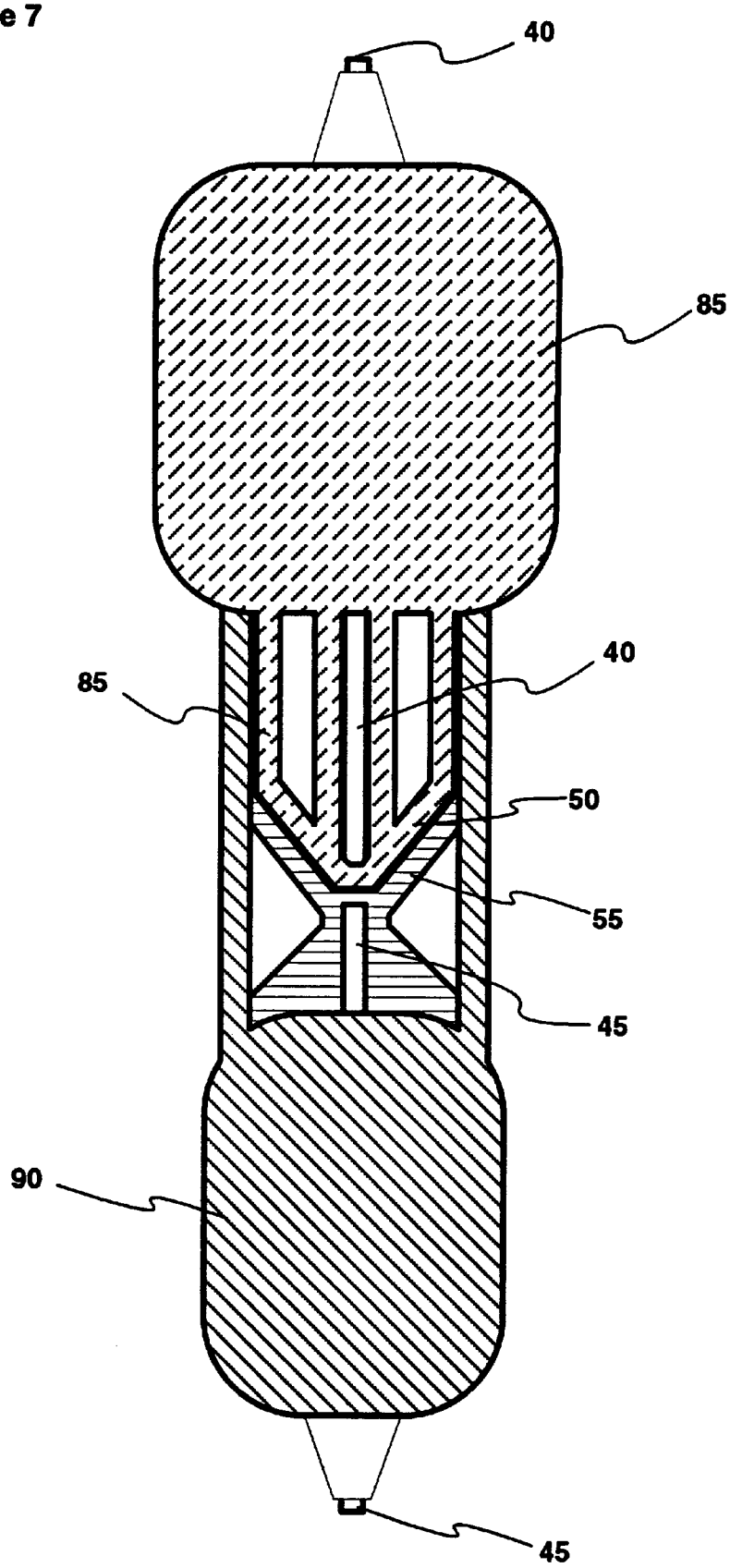
FIG. 7 is a top elevation view of the overlapping connective and alignment means.
Figure 8:
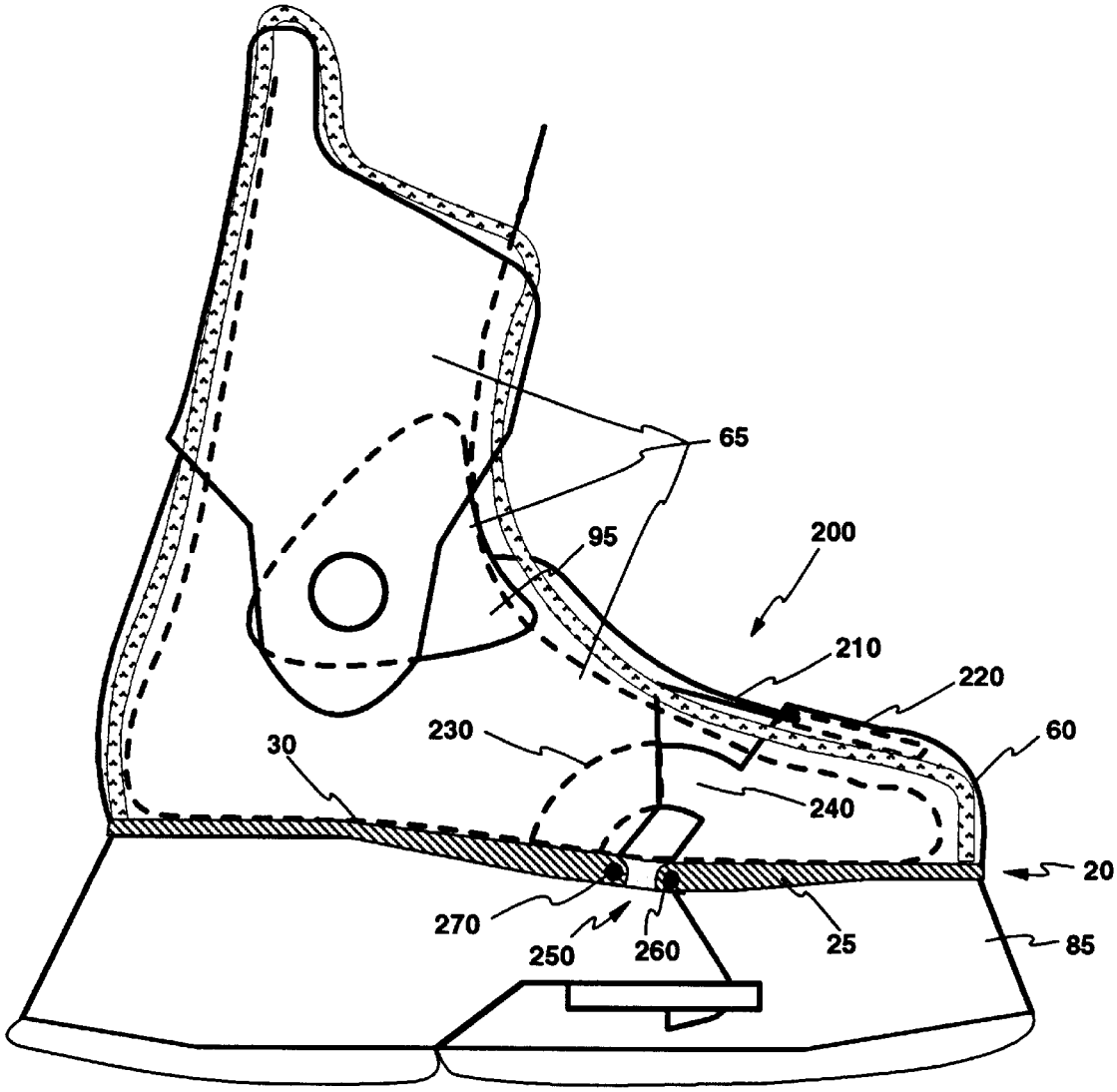
FIG. 8 is a side elevation view of a second embodiment of the present invention with the blade means in the aligned horizontal position.
Figure 8A:
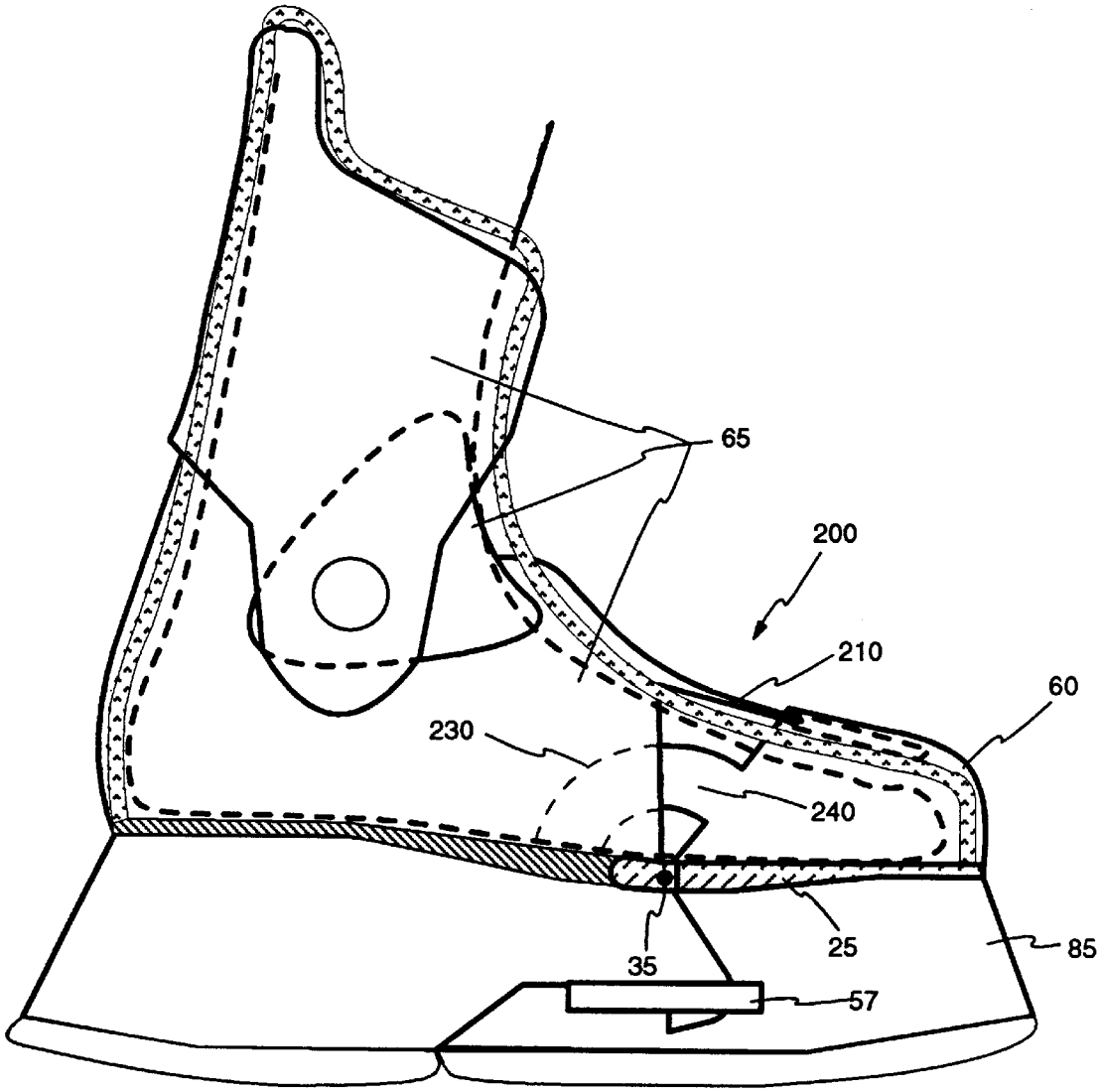
FIG. 8A is a side elevation view of the embodiment of FIG. 8, with a single hinge.
Figure 9:
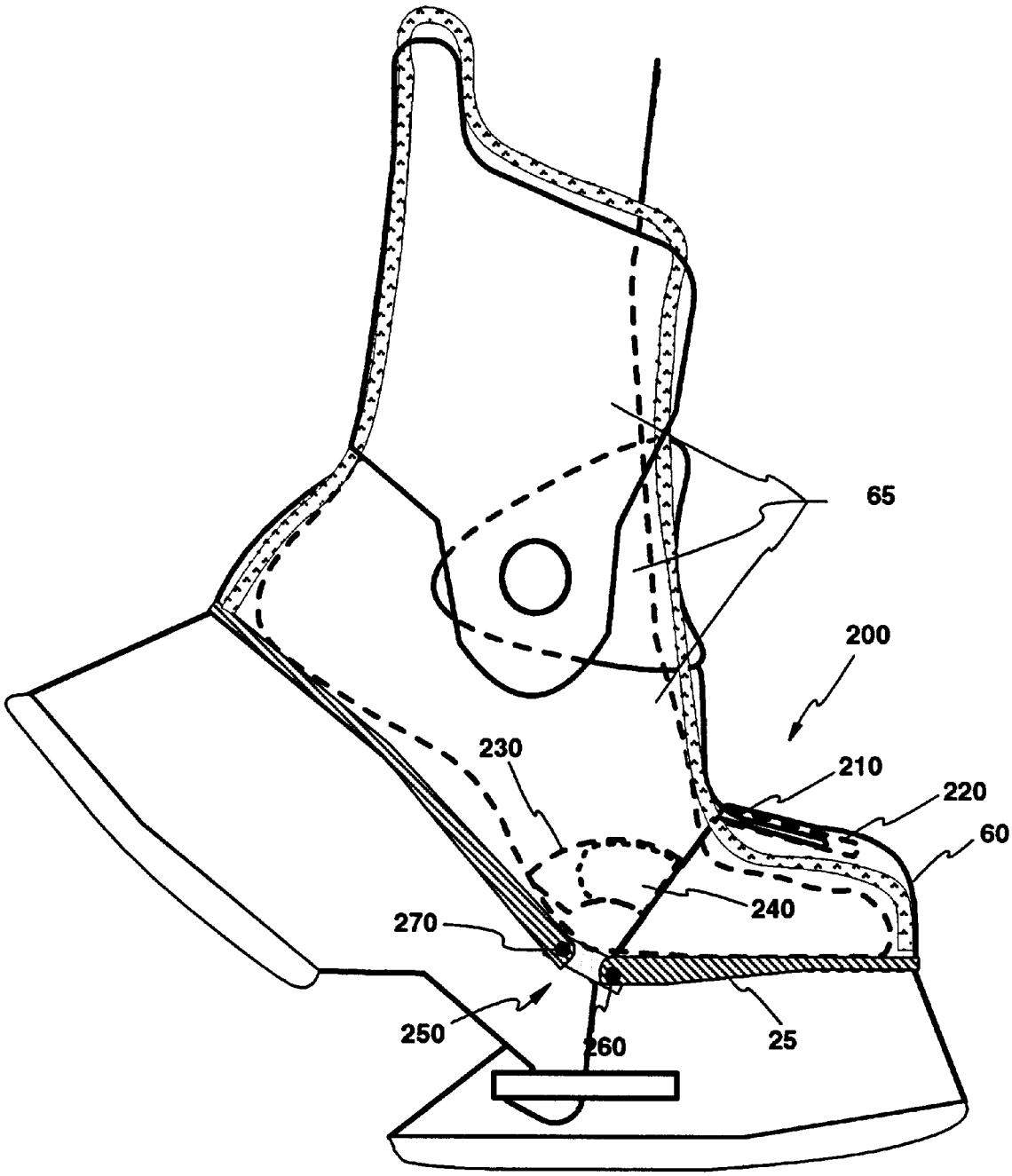
FIGS. 9 to 9B are further side elevation views of the embodiment of FIG. 8.
Figure 9A:
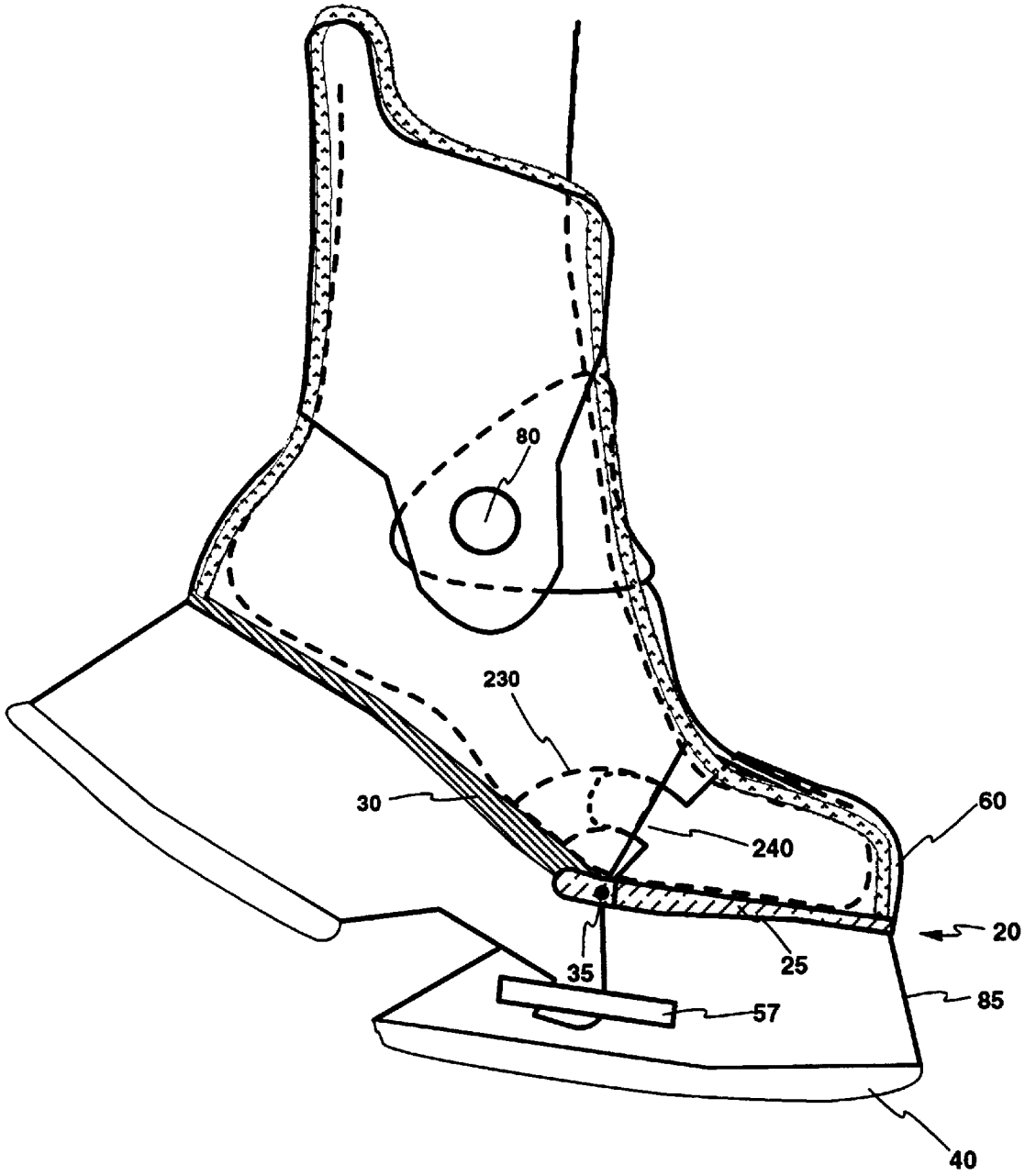
Figure 9B:
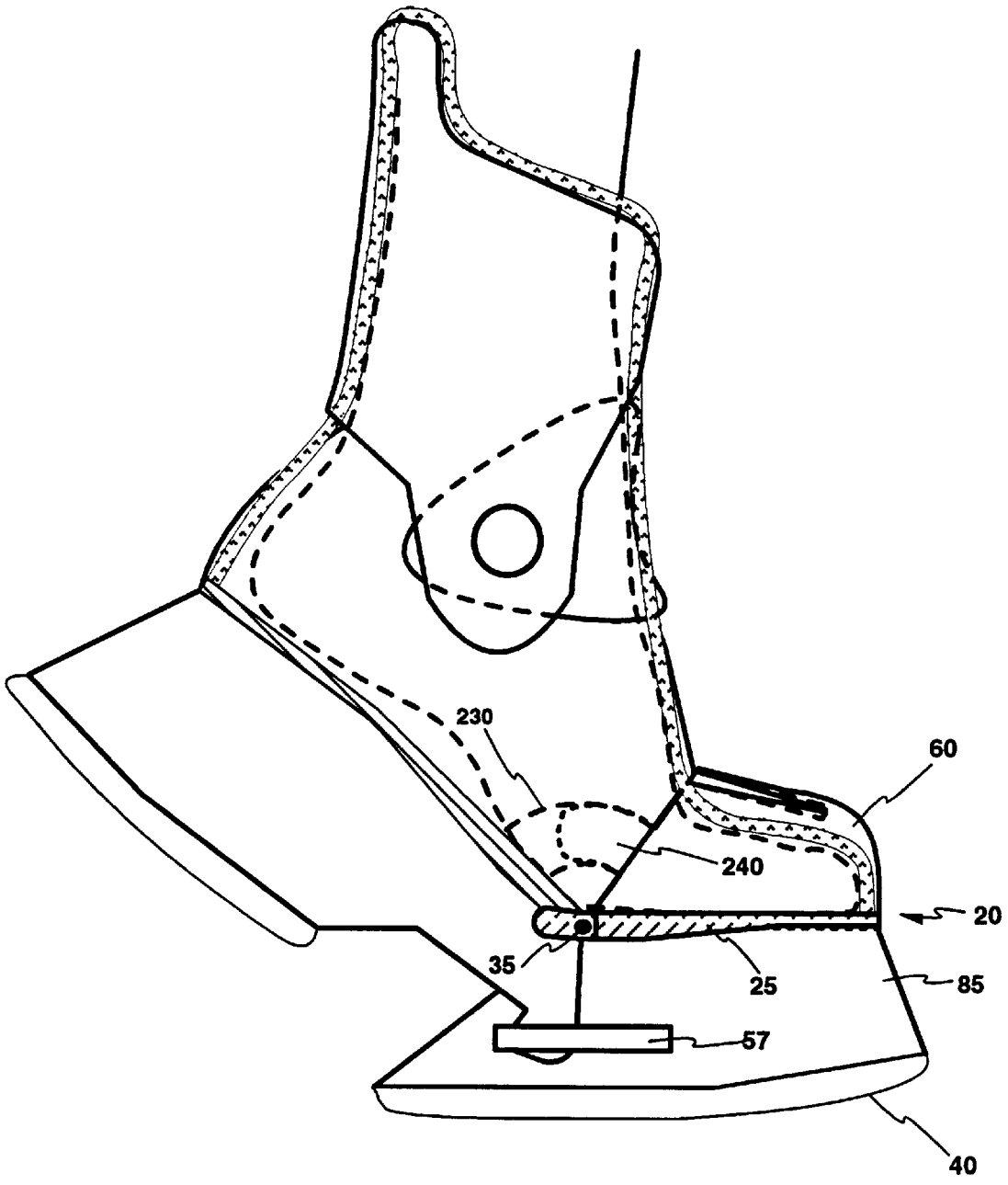

As shown in FIGS. 1, 2, 3 and 6, the anterior portion 40 of the ice skate blade means 13 and the anterior connective means 85, have a posterior face 50, and the posterior portion 45 of the ice skate blade means 13 and the posterior connective means 90, have an anterior face 55. As shown in FIGS. 1 and 6, the posterior face 50 and the anterior face 55 come into contact when the ice skate 10 is in the first position. FIGS. 1, 2, 3, 5, 6 and 7 illustrate that in this configuration, the posterior connective means 90 overlaps the anterior connective means 85 in a tongue in groove fashion (where the anterior connective means 85 is the tongue and the posterior connective means 90 is the groove). As do the other overlapping sections, such as those in the boot, this restricts lateral flexibility, thus providing support for the skater's foot and ankle. FIG. 7 illustrates that the interface between the anterior connective means 85 and the posterior connective means 90 is 'V' shaped to further ensure that as the skate returns to its upright position, the posterior portion 45 of the blade means is brought into correct alignment with the anterior portion 40 of the blade means. Alternative configurations, for example with the anterior connective means 85, overlapping the posterior connective means 90 (where the posterior becomes the tongue and the anterior the groove), are merely optional manifestations of the same principles.

As shown in FIG. 1, the upper portion 15 of the boot 12 includes an anterior portion 60 and a posterior portion 65. The anterior portion 60 of the boot 12 is rigidly attached to the anterior portion 25 of the footbed 20. The posterior portion 65 of the boot 12 is rigidly attached to the posterior portion 30 of the footbed 20. The first hinge 35 therefore enables the anterior portion 60 and the posterior portion 65 to pivot relative to each other. Limiting the point beyond which such forward flex is restricted is effected by way of stop means 57. Such stop means can be variously constructed and located and may include adjustment means in which to tailor the skate function to suit the skater's needs.

Figure 2:
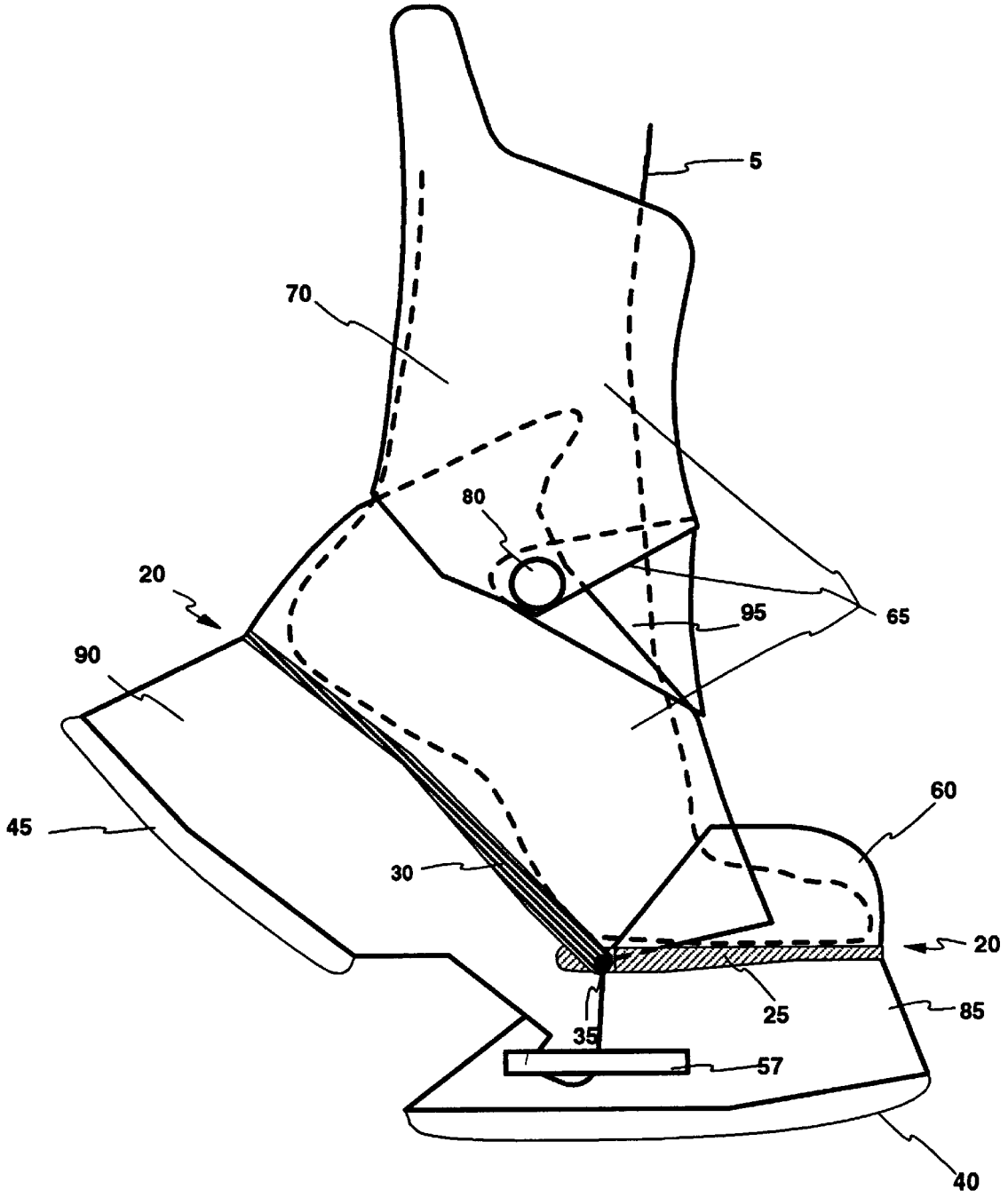
FIG. 2 is a side elevation view of the embodiment of FIG. 1 with the blade means in the pivoted position.
Figure 3:
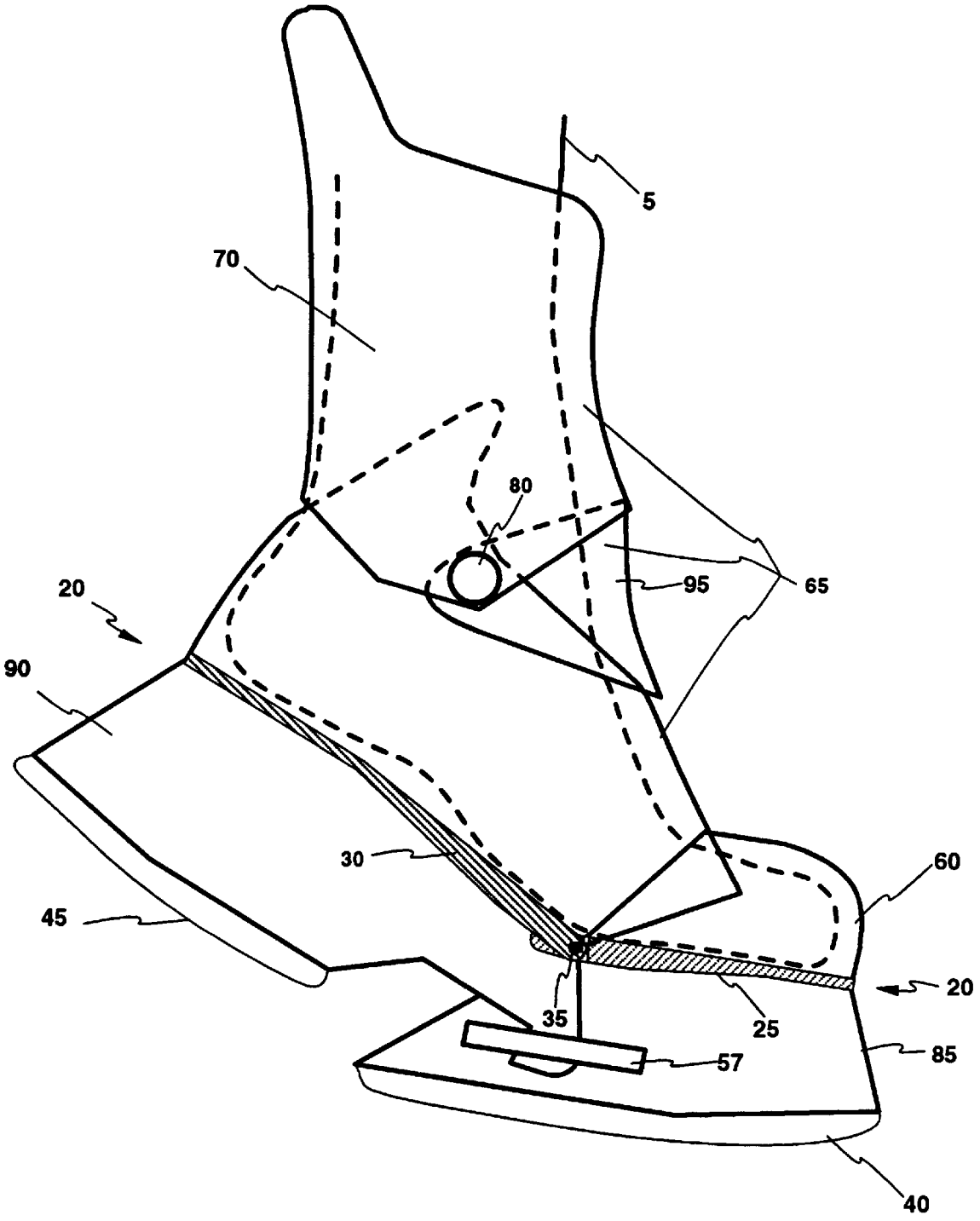
FIG. 3 is a side elevation view of the embodiment of FIG. 1 with the blade means in a restricted pivoted position.

FIG. 2 illustrates the invention allowing maximum flex; however, as is shown in FIG. 3 the adjustment or alternative placement of the stop means 57 thereby restricts the forward flex capacity of the posterior portion 65, relative to the anterior portion 60. By allowing, and then limiting, flex in the footbed, and thereby shifting the fulcrum from the ball of the foot to the tip of the blade (or the bottom of the front wheel), such means allow the invention to effect a gearing aspect to the skate, providing a "two-speed range," with "fully automatic shifting" for each skating stride, none of which is possible with conventional skates.

The posterior portion 65 of the boot 12 includes a cuff portion 70 and a heel portion 75, and an overlapping central portion 95. This central portion 95 may consist of one of more overlapping or interlocking sections, and may be variously constructed. A second hinge 80 functioning over and with the skater's ankle, adjoins the cuff portion 70, the heel portion 75, and the overlapping section(s) 95. This hinge means 80 permits backward and forward pivotal movement of the cuff portion 70 and the heel portion 75 relative to each other. The second hinge 80 may be variously constructed. The overlapping central portion(s) 95 provides lateral support and protection while allowing full calf muscle extension.

Figure 4:
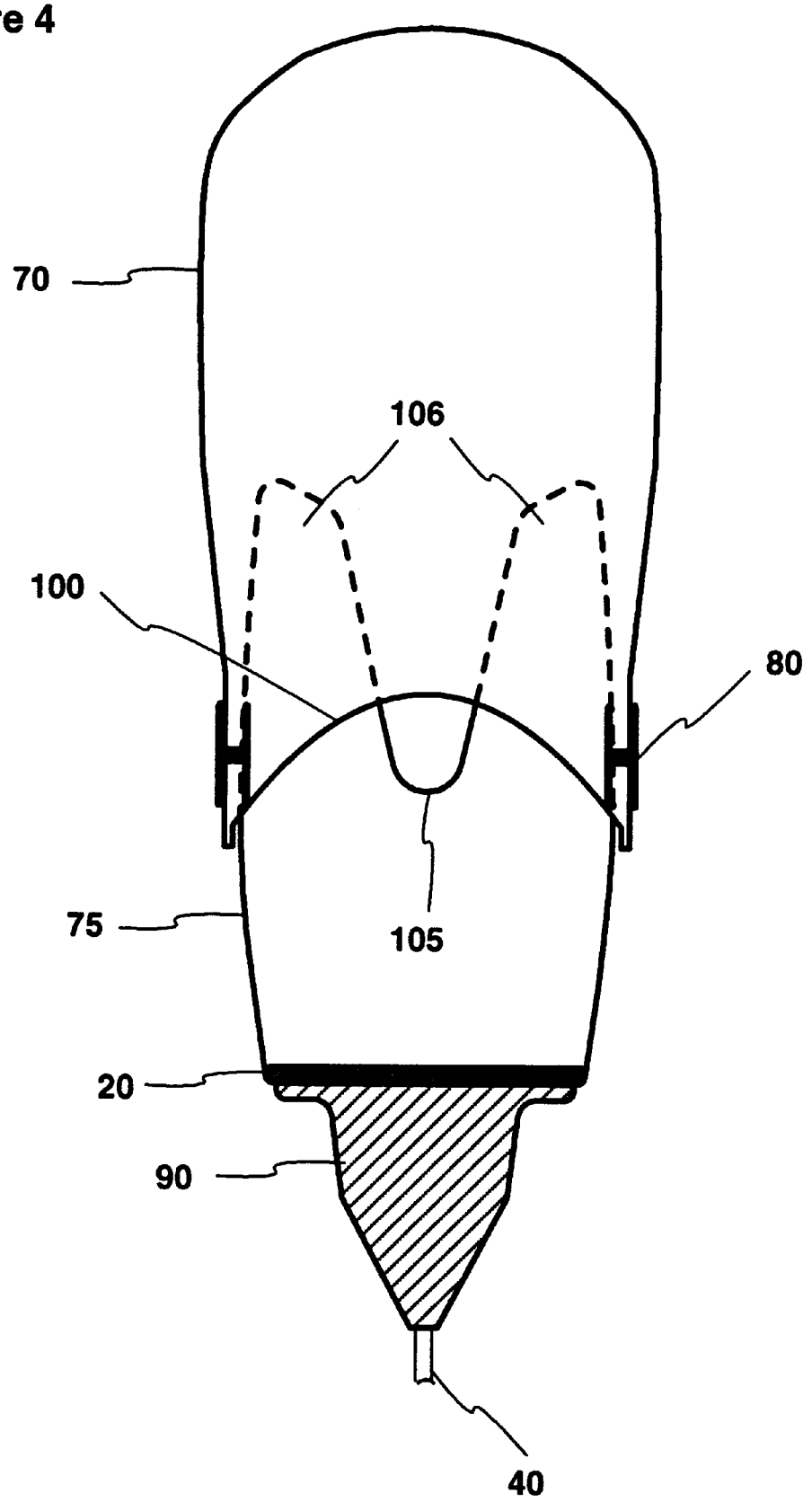
FIG. 4 is a rear elevation view of the embodiment of FIG. 1.
Figure 5:
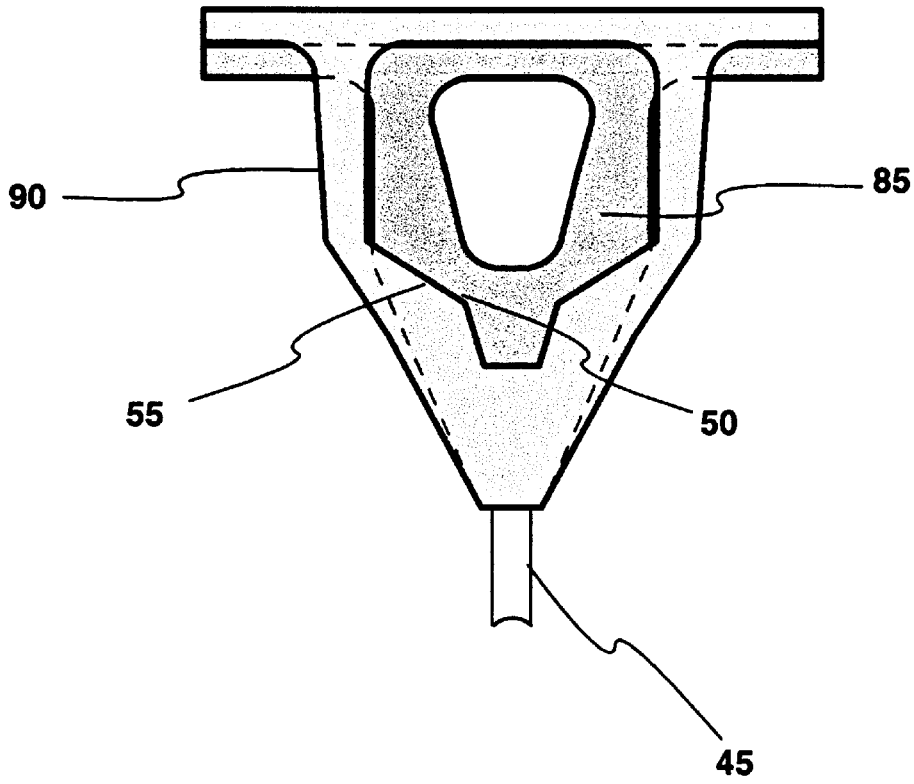
FIG. 5 is a cross-sectional rear elevation view of the overlapping connective means in a "posterior outside" configuration.

FIG. 4 illustrates the design of the cuff portion 70 and the heel portion 75 of the posterior portion 45 of the upper portion 15 of the boot 12. The cuff portion 70 includes an upwardly extending arch 100 to permit the cuff portion 70 to rotate towards the backward position without contacting the heel portion 75 prematurely. The heel portion 75 also includes a downwardly extending notch 105 to facilitate flex in the heel portion 75. This notch 105 and upwardly extending fingers 106 accommodates the cuff (posterior) pivoting backward from the ankle, as the skate moves toward the second position.

When in use by a skater on an ice surface, the ice skate 10 operates as follows. Upright/gliding position: When the skater's weight is positioned centrally, as in an upright or gliding position, the skate 10 is in the first position, as illustrated in FIG. 1. In the first position, both the anterior portion 40 and the posterior portion 45 of the ice skate blade means 13 can be in contact with the ice surface. The angle of contact, and the proportion of anterior 40 and posterior 45 portions in contact with the ice surface depends upon the skater's weight placement, and the positioning and amount of "rocker" (curvature) incorporated into the blades. One advantage of this skate's mid-flex ability over that of a conventional skate's single and rigid blade, is that the contact area can be lengthened to provide greater stability. Such is not possible with conventional skates without an implicit disadvantage in stride mechanics and maneuverability. Additionally, the present invention enables the relative distance to the foremost point of the anterior blade 40 to be lengthened (moved forward), to gain mechanical advantage during the final stages of each skating stride.

Skate thrust/striding: During the initial portion of a forward skating stride, the skater begins a weight transition, shifting weight both forward and laterally, off of the striding (or pushing) skate, and onto the gliding skate. In this transition, the skater pushes the striding skate outward, away from that skate's inside edge. As the stride is initiated, the skater's weight on the striding skate shifts forward onto the anterior portion 40, and the hinge means 35 between the anterior and posterior portions of the skate allows the footbed to flex, thereby pivoting the posterior portion 45 off the skating surface, and the skate begins to flex into the second position as illustrated in FIGS. 2 and 3.

While in this second position, only the anterior portion 40 of the ice skate blade means 13 contacts the ice, and the skater has the advantage of enacting the initial thrust of calf muscle extension through a fulcral point at the ball of the foot, as opposed to the more forward position at the tip of the blade. Power and thrust generated by the skater's initial calf muscle extension is therefore used more effectively than with a conventional skate having a rigid footbed. When the flex between the posterior portion 65 and the anterior portion 60 is restricted by the stop means 57, as illustrated in FIG. 3, the fulcrum for further extension is shifted to the tip of the blade, thereby gaining the mechanical advantage of a higher gear for final calf muscle extension.

Referring to FIGS. 8 to 14, there is shown a second embodiment of the present invention.

FIGS. 8 to 13 illustrate slidably interlocking interface 200 allows the anterior portion 60 and the posterior portion 65 to pivot relative to each other. The slidably interlocking interface 200 allows for biomechanically efficient relative movement, while ensuring that adequate support is provided to the skater. The slidably interlocking interface 200 includes upper posterior projections 210 that slide into upper anterior sleeves 220. The slidably interlocking interface 200 also includes lateral posterior sleeves 230 that receive lateral anterior projections 240.

Figure 10:
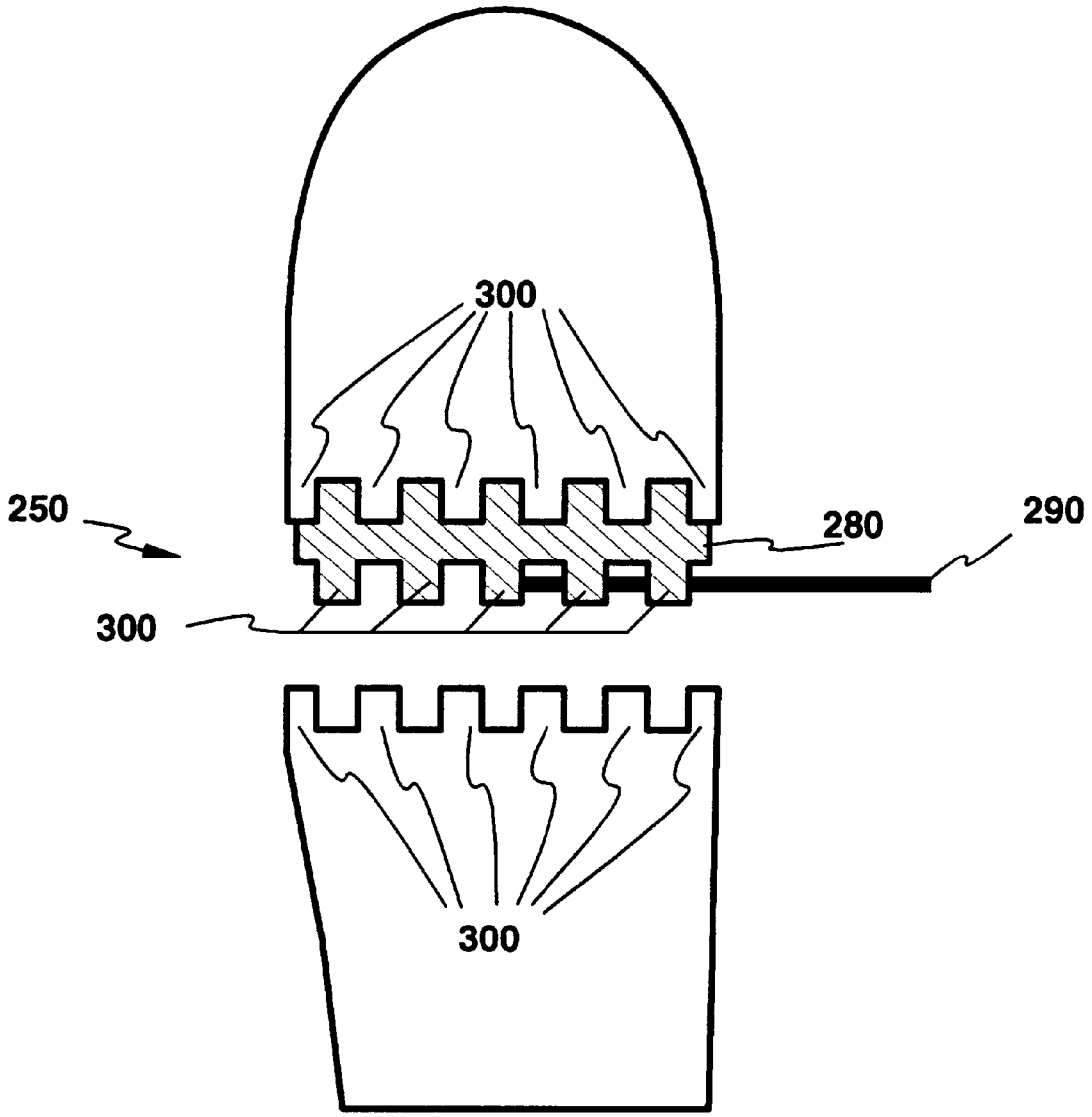
FIG. 10 is a top plan view of the hinge of the embodiment of FIG. 8.
Figure 11:
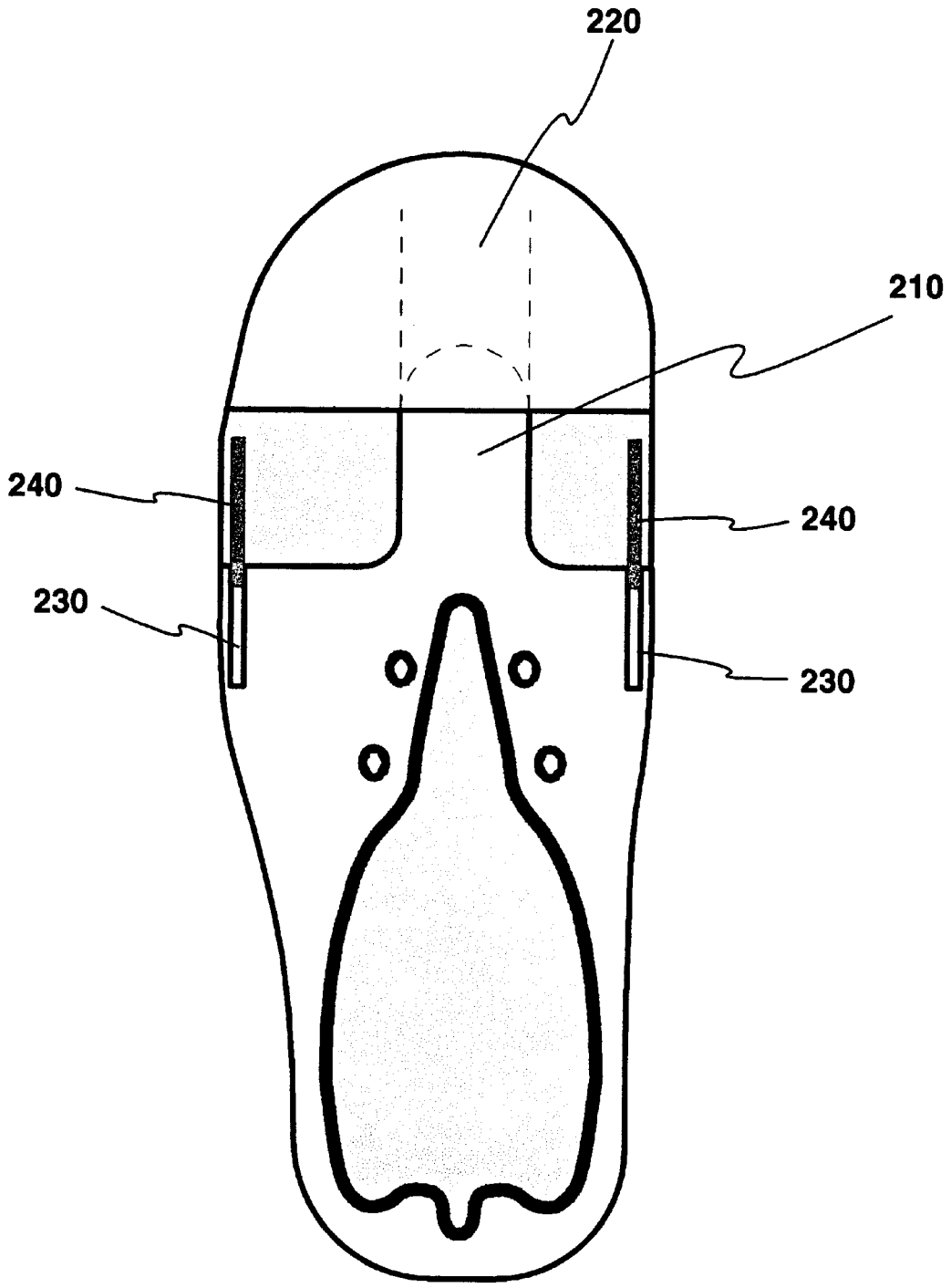
FIGS. 11 to 13 are alternative top plan view of the slidably interlocking interface of the embodiment of FIG. 8.
Figure 12:
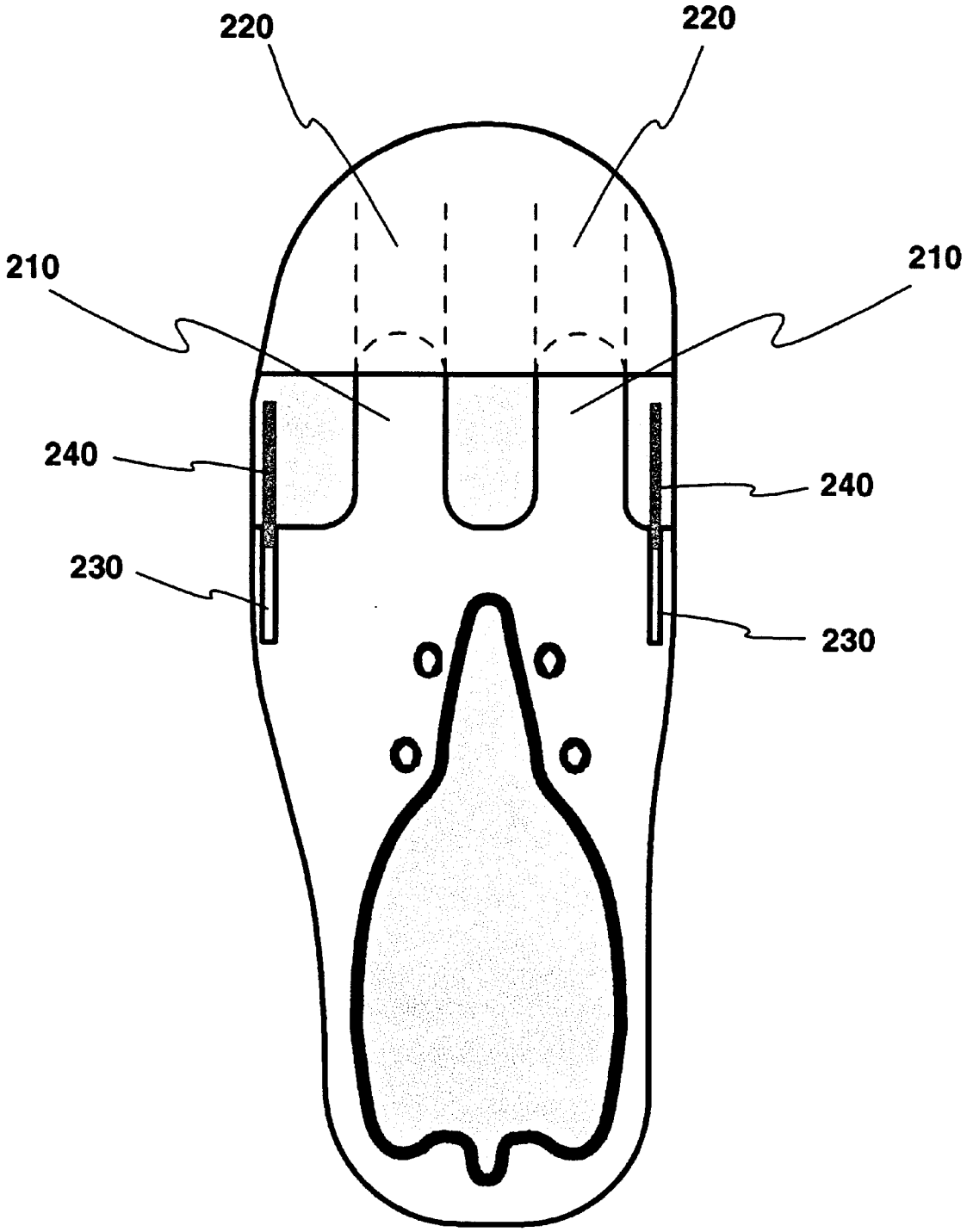
Figure 13:
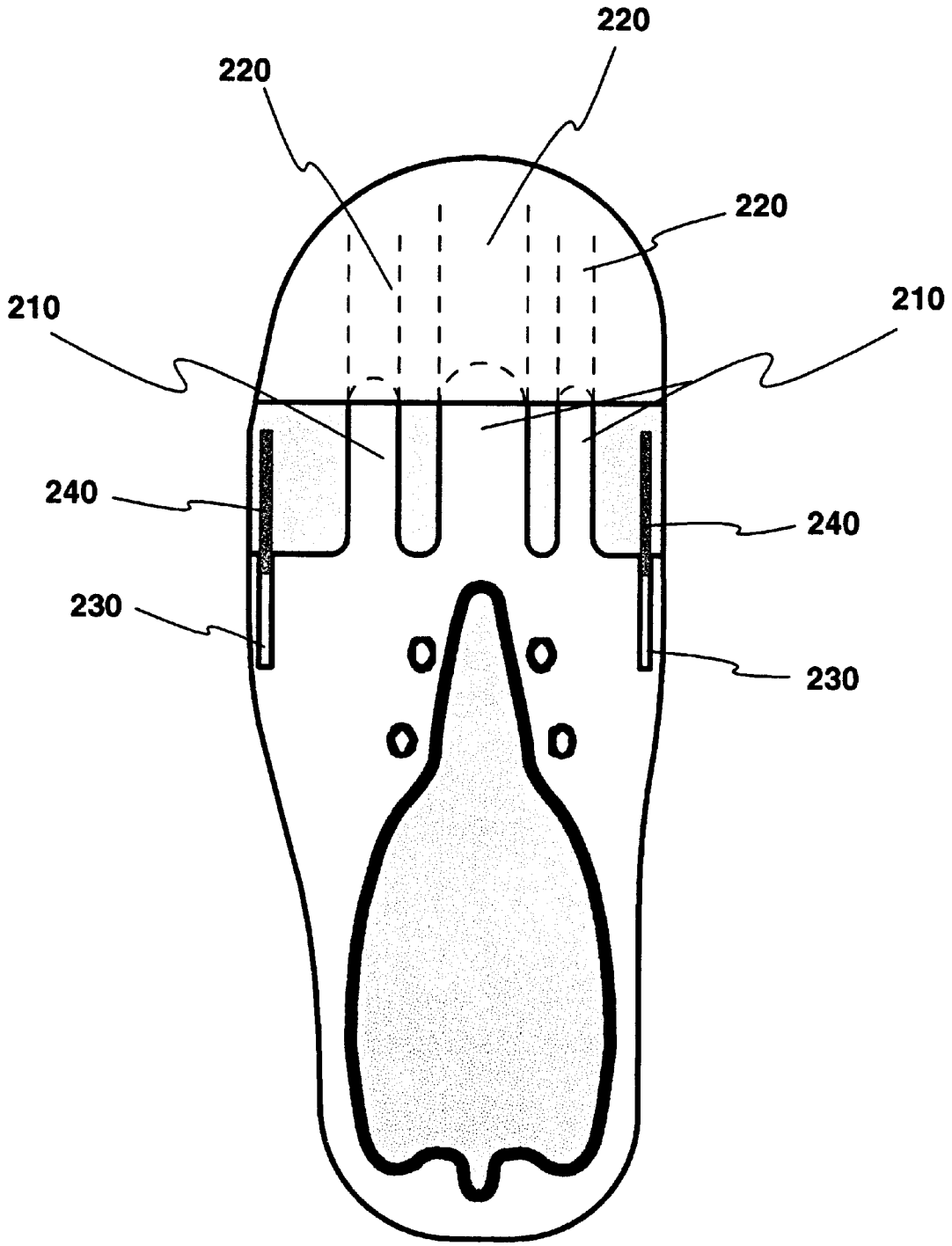

Referring to FIGS. 8 to 13, a complex hinge 250 includes an anterior hinge 260, a posterior hinge 270 and a floating link 280 therebetween. Note that there could be more than one floating link and more than two hinges. Note that the complex hinge 250 is located such that it is posterior to the joint of the ball of the foot of a skater. FIG. 10 illustrates the complex hinge 250 in further detail. Hinge pins 290 pass through holes in projections 300 adding strength and rigidity. The complex hinge 250 provides good lateral stability, and is also incorporated into the footbed 20 so that there is no gap between the anterior portion 25 and the posterior portion 30.

Figure 14:
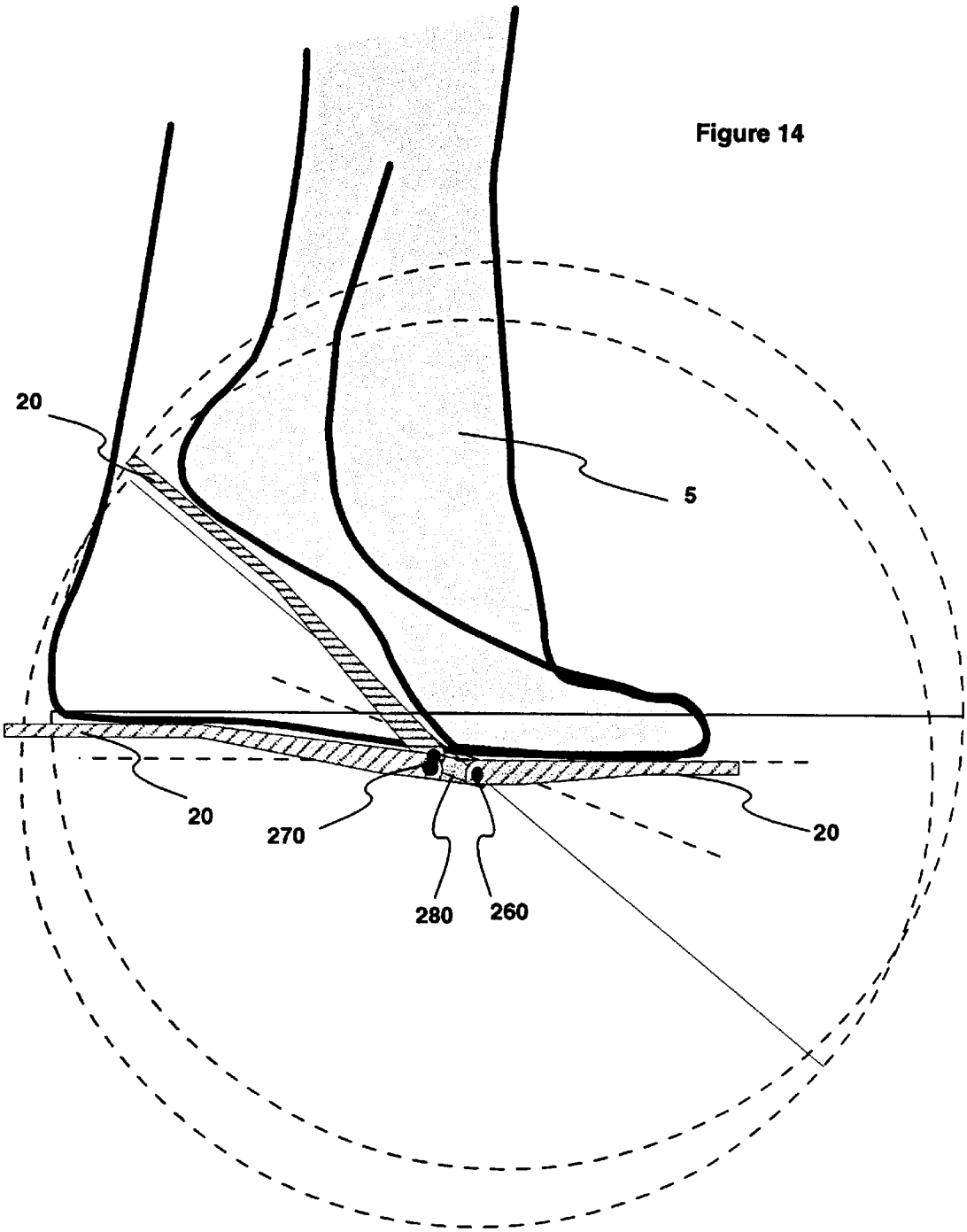
FIG. 14 is a side elevation view of the footbed of the embodiment of FIG. 8.

FIG. 14 illustrates the movement of the footbed 20, including the complex hinge 250, and the foot of a skater.

Allowing efficient plantar flexion (calf muscle extension with flex at the ball of the foot) in recreational skates confronts several challenges: the skate must be lightweight, yet there is a significant need for lateral integrity and support, a substantially rigid sole is required in order to attached the blade (or wheel) means, and the biomechanical characteristics are somewhat dynamic.

The natural pivot at the ball of the foot takes place at the joint between the distal end of the metatarsals and the proximal end of the phalanges. The primary pivot point (that of the great toe) is typically 1.5 to 2 cm above the sole of the foot. Taking into account the thickness of a skate liner and sole, any sub-sole hinge would necessarily displace this pivot point by approximately 2.5 cm. This displacement implies eccentricity with respect to the pivot; the natural foot arc would be somewhat opposed by that imposed by the hinge. The greater the eccentricity, the greater the restriction of function.

In normal footwear, eccentricity is eliminated because the shoe allows a pivot at the natural point of flex, and the sole is flexible throughout the region. The sole, therefore, pivots through a continuous series of points that form an arc around the ball of the foot. For a molded skate, the rigidity of the material would require the incorporation of a hinge means directly over the pivot point at the ball of the foot. While this would allow appropriate flexibility, lateral integrity is significantly compromised by both the hinge and the flexible sole it necessitates.

The importance of lateral integrity in skates requires that the torsion characteristics of a flexible sole be greatly reduced. The incorporation of a sub-sole plate/hinge(s) could offer increased rigidity, but would imply both eccentricity and differential restriction unless the sole is split and the portions sufficiently separated. (As a full length or solid sole would flex, any rigid sub-sole plate/hinge would necessarily have to accommodate a greater arc). Separation of the toe and heel portions would allow the necessary differential, however it implies a significant gap in the sole. In this configuration, the weight and flex pressure of the foot would tend to force the liner into this gap, potentially pinching and abrading the foot and liner.

Further, the option of including sub-sole plate/hinge(s) to accommodate the above described physical restrictions would add considerable complexity and cost to skate construction. To provide sufficient rigidity, strength, and durability, a sub-sole plate/hinge and its attachment screws would be required to be constructed of a high quality material such as stainless steel or titanium that would imply additional weight.

The invention offers a number of alternative solutions to these problems. First is the slidably interlocking components of each of the molded sections. Second is the incorporation of torsion resistant hinge means directly into, as opposed to under, the sole. This would offer torsion resistance while greatly reducing the arc differential. It would eliminate any gap in the sole. Its incorporation as part of a moulded skate would offer more elegant and efficient construction and a more durable product. It would allow the inclusion of multiple torsion resistant hinge means to accommodate a full range of flex characteristics. Third is the combination of the slidably interlocking components of each of the molded sections with the torsion resistant hinge means.

Figure 15:
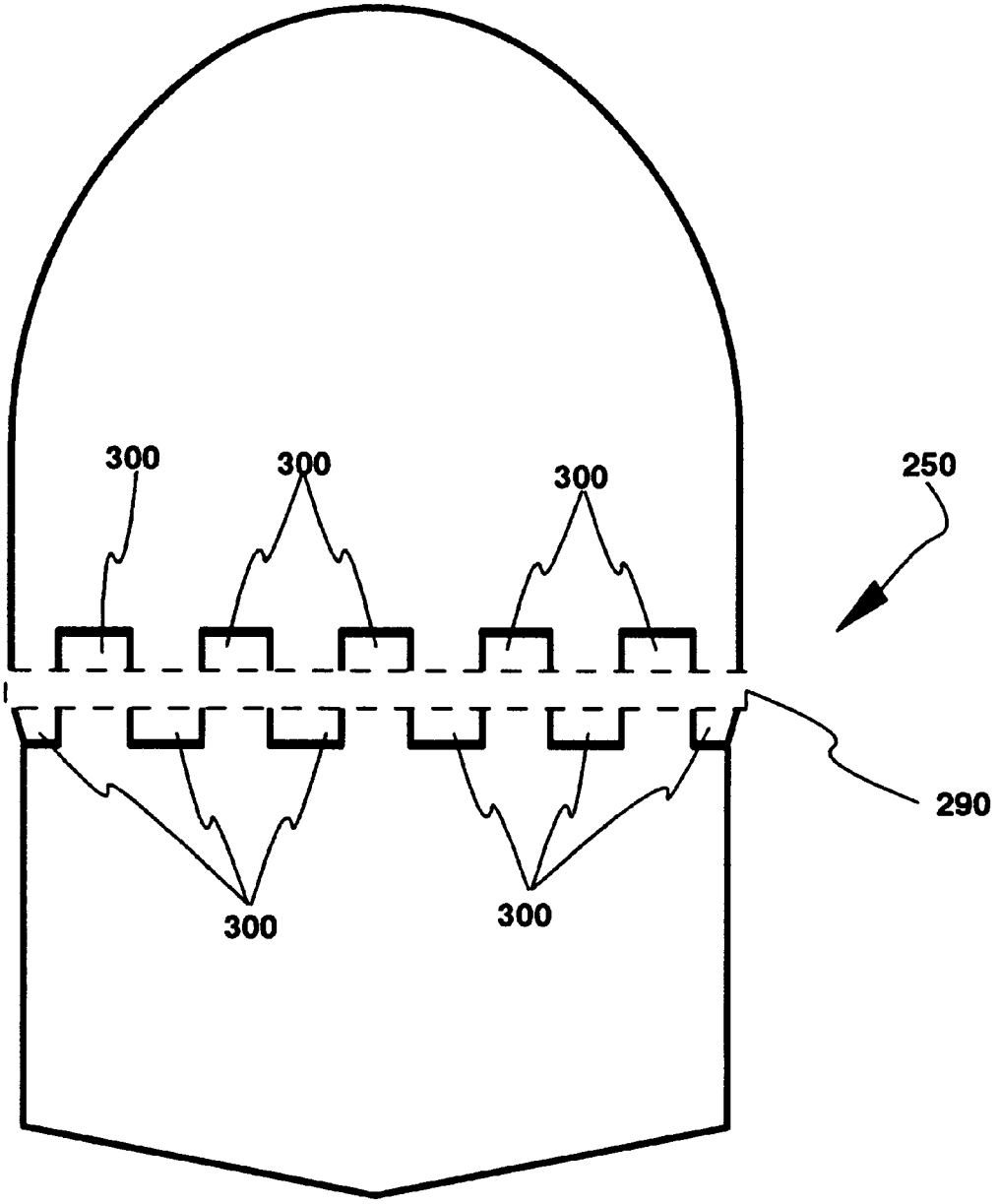
FIGS. 15 to 17A are further views of the hinge and slidably interlocking interface.
Figure 16:
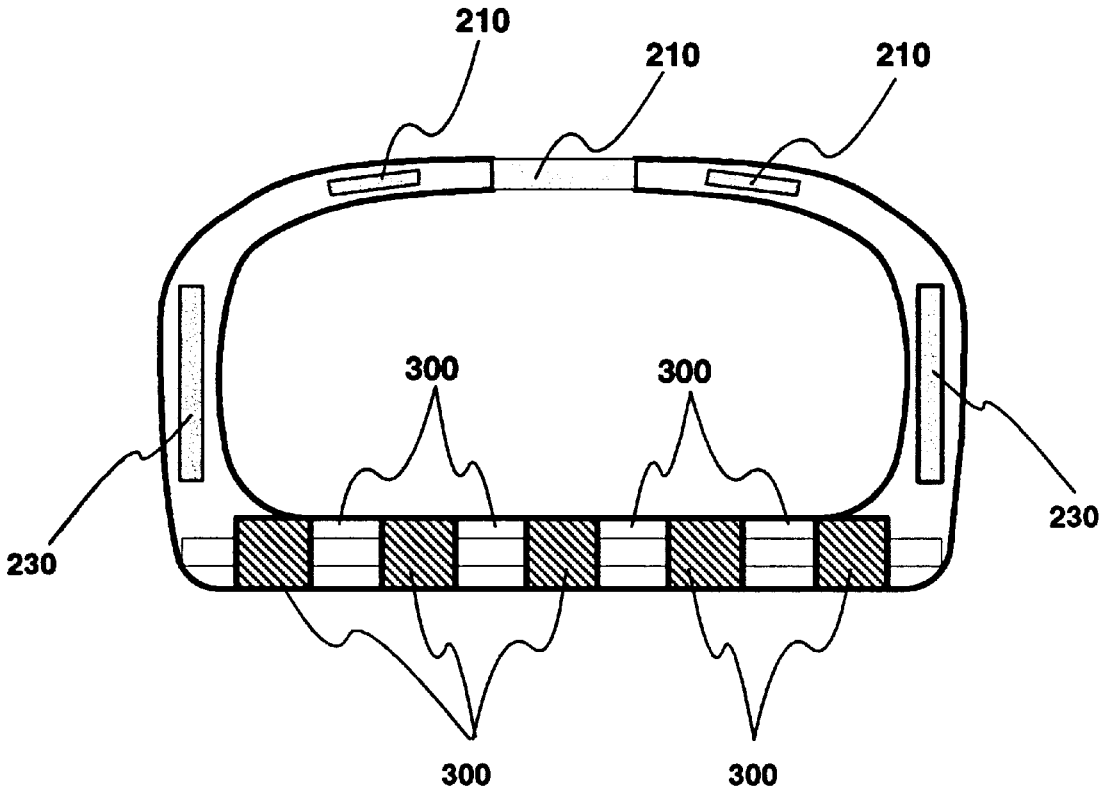
Figure 17:
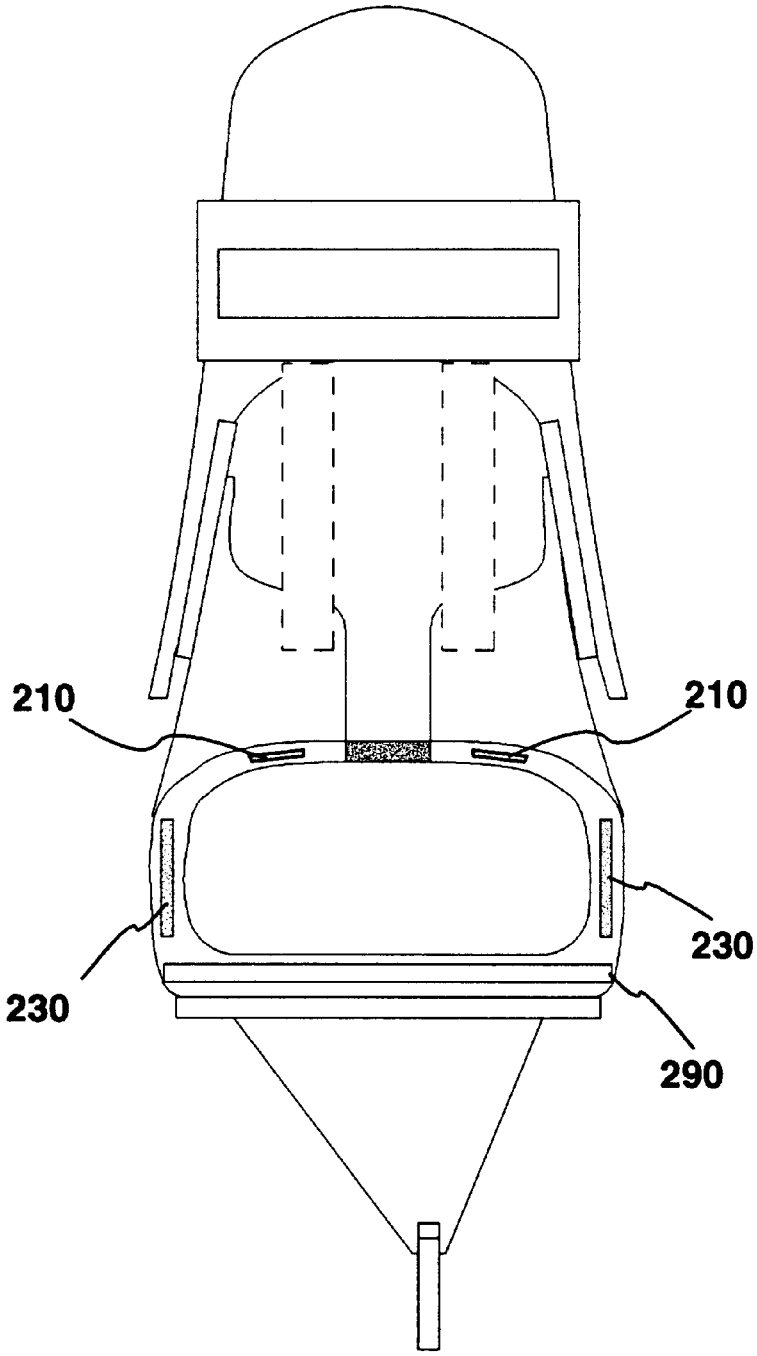
Figure 17A:
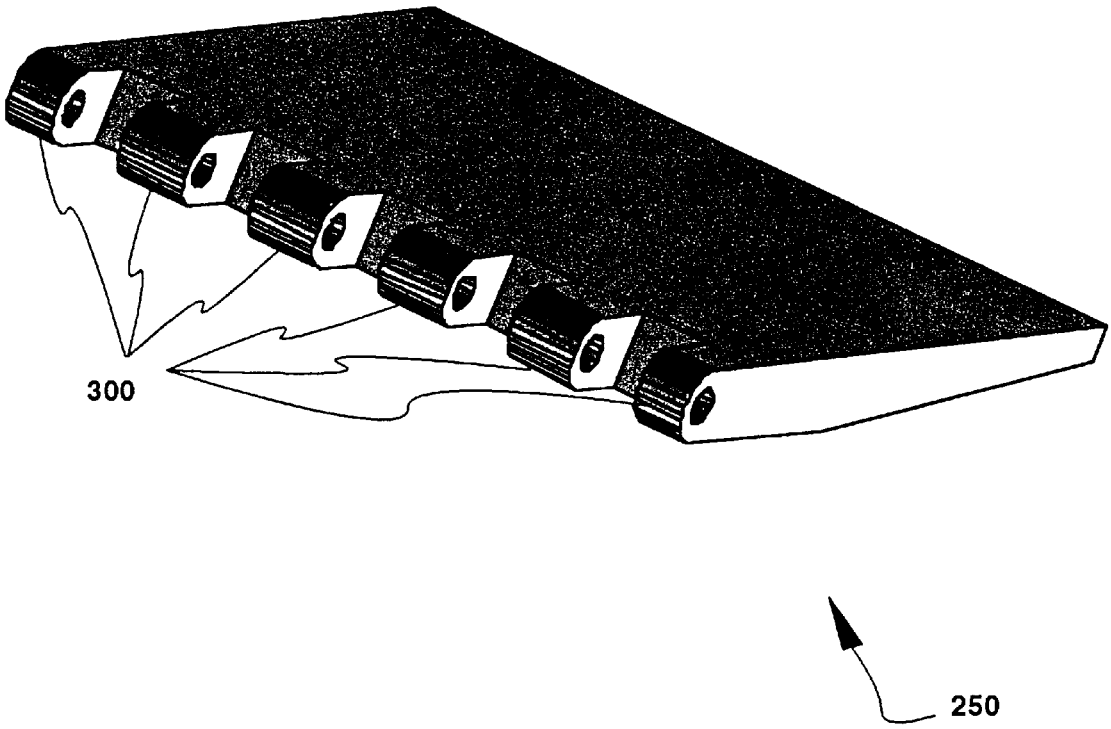

FIGS. 15 to 17 illustrate further hinge and interlocking interface embodiments.

Figure 18:
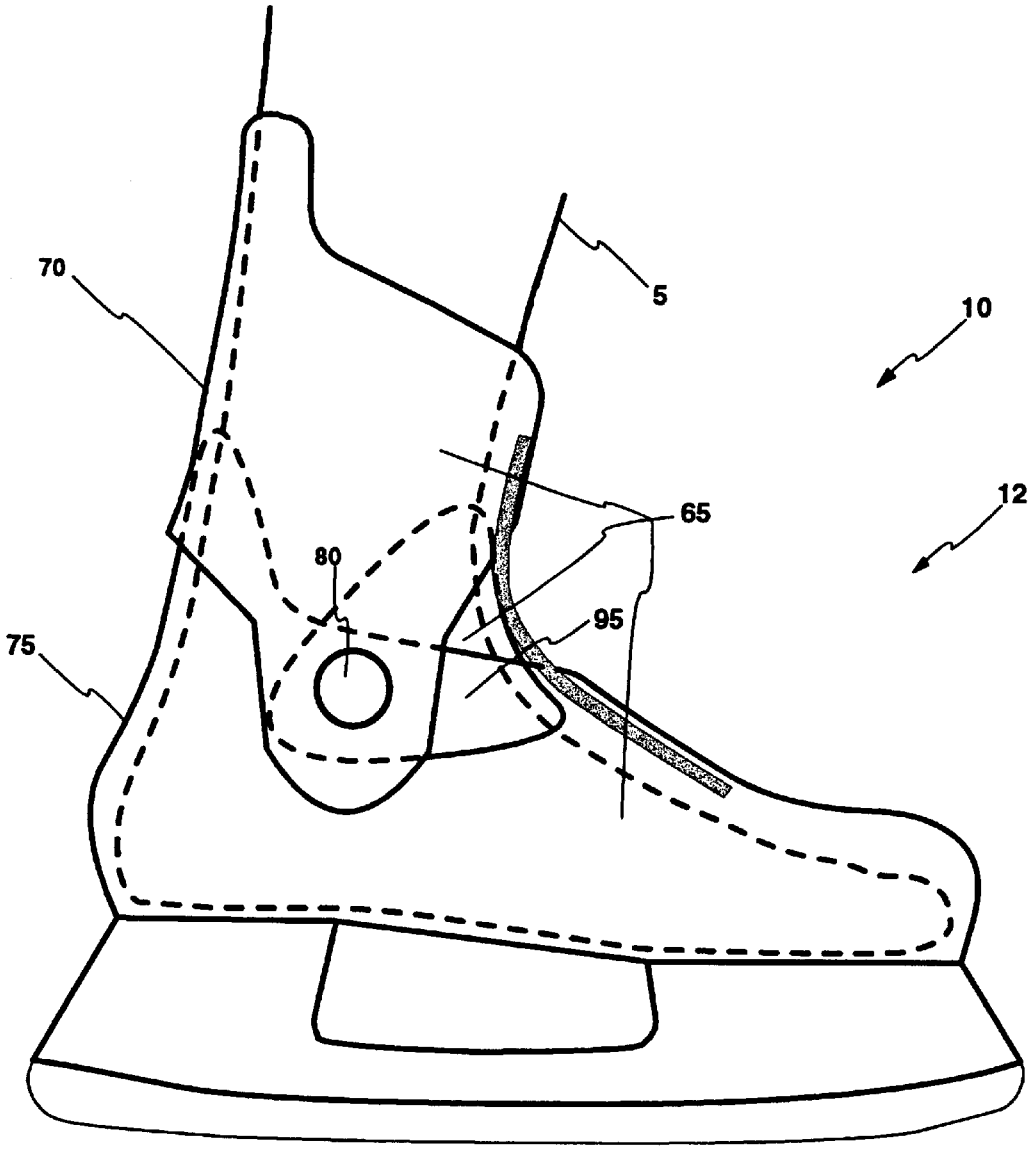
FIGS. 18 to 19A are side elevation views of a third embodiment of the present invention.
Figure 18A:
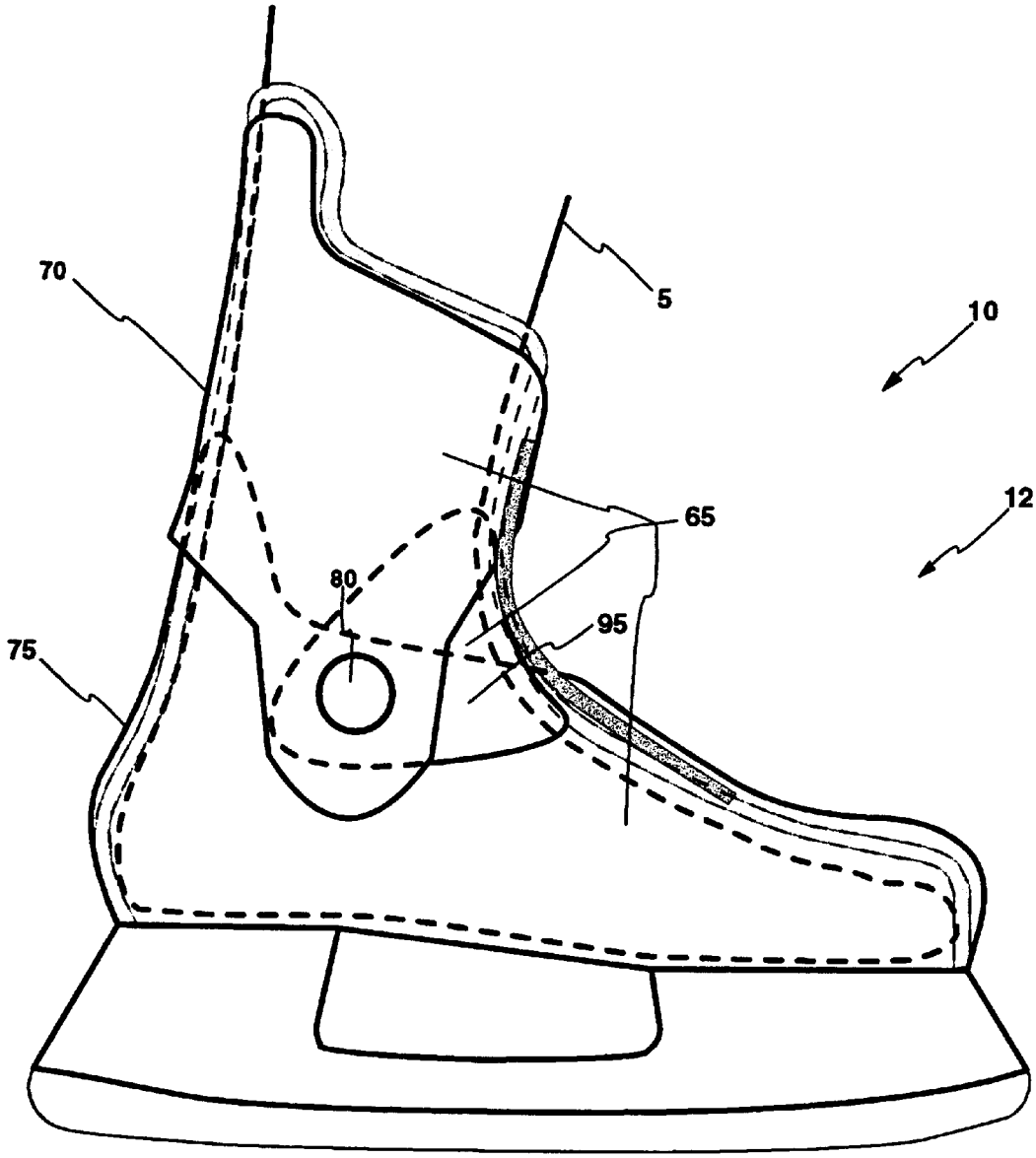
Figure 19:
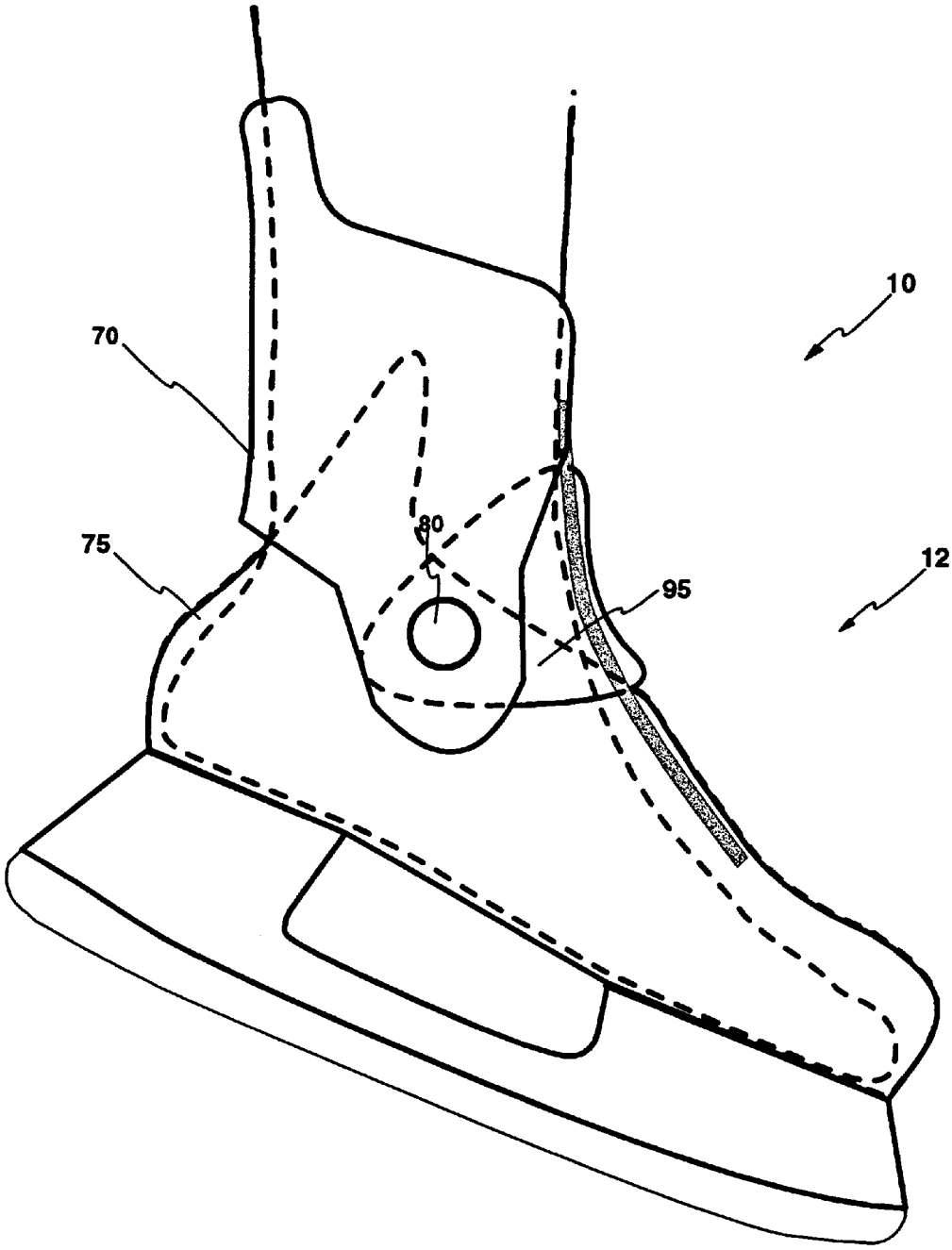
Figure 19A:
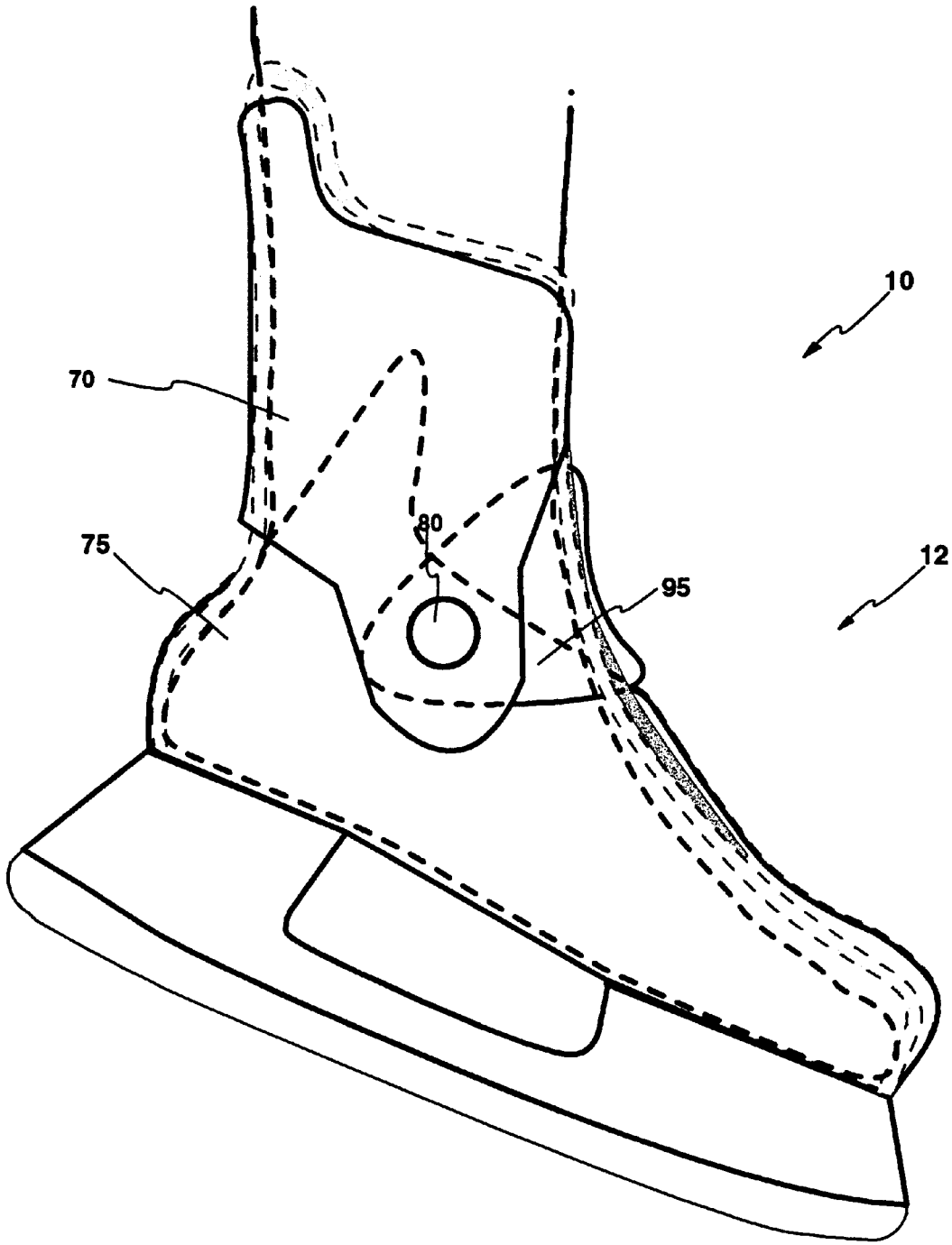

FIGS. 18 and 19 illustrate a third embodiment of the invention in which the footbed 20 is not hinged.

Figure 20:
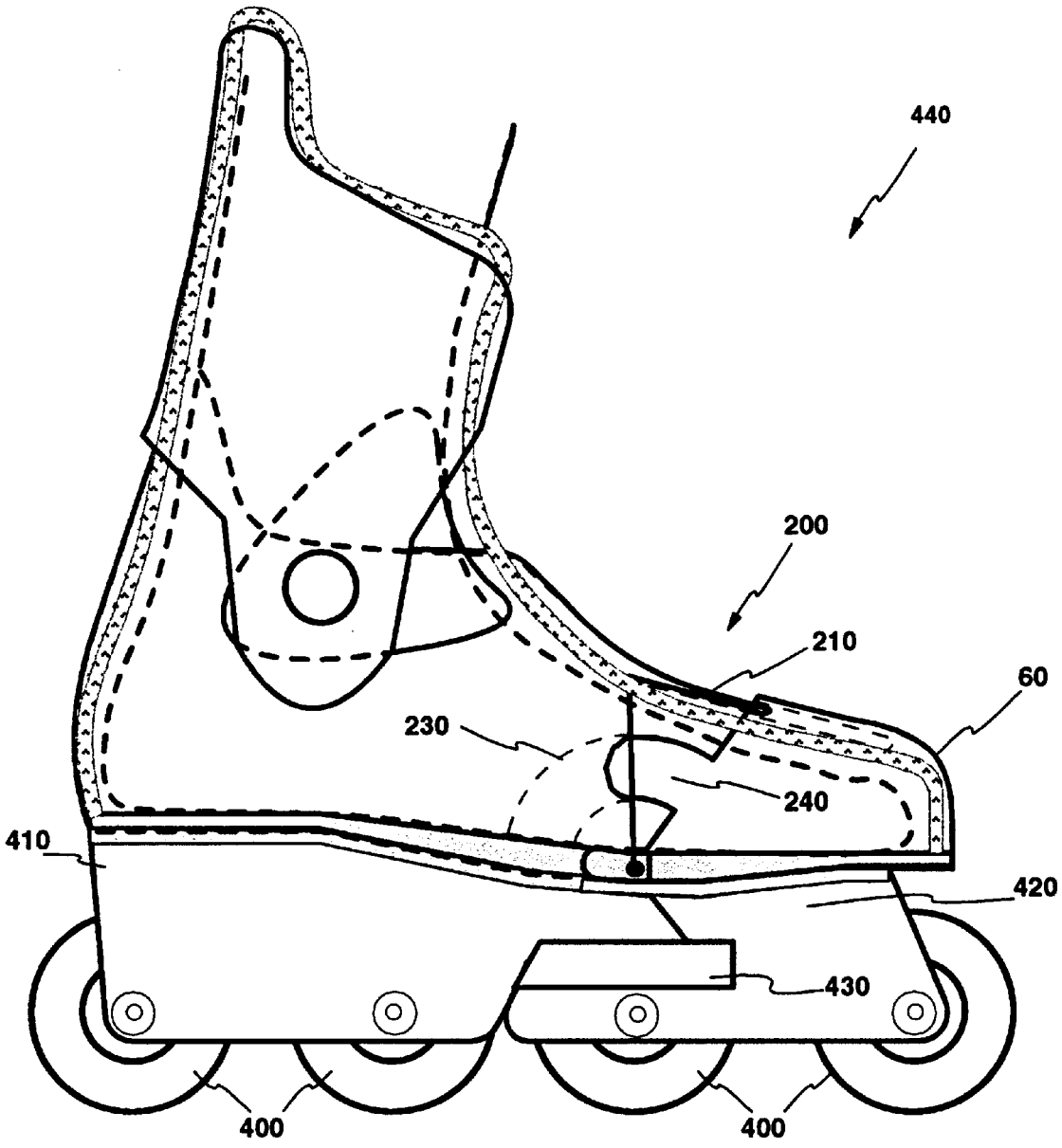
FIGS. 20 to 22 are side elevation views of a fourth, inline skate, embodiment of the present invention.
Figure 21:
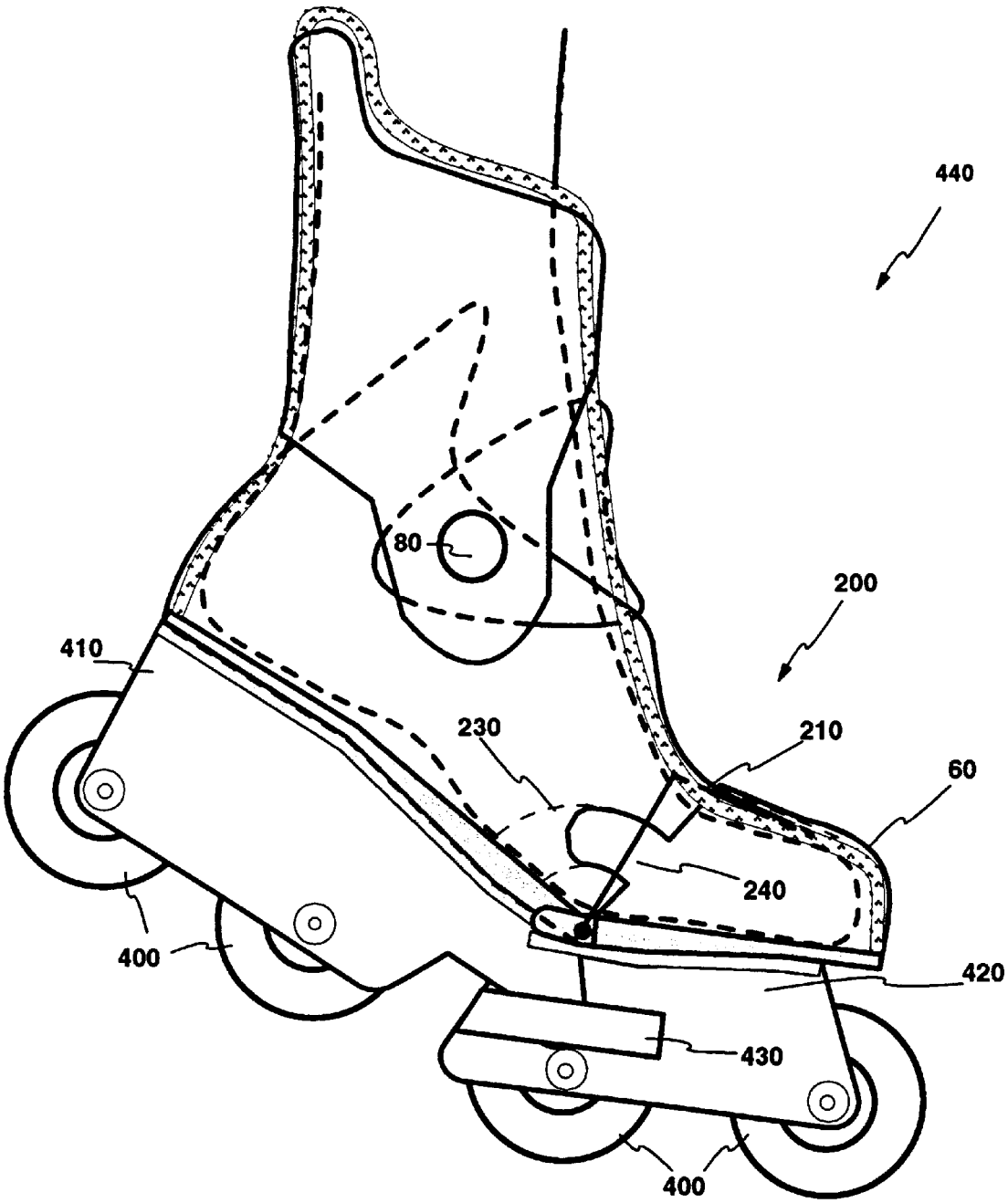
Figure 22:
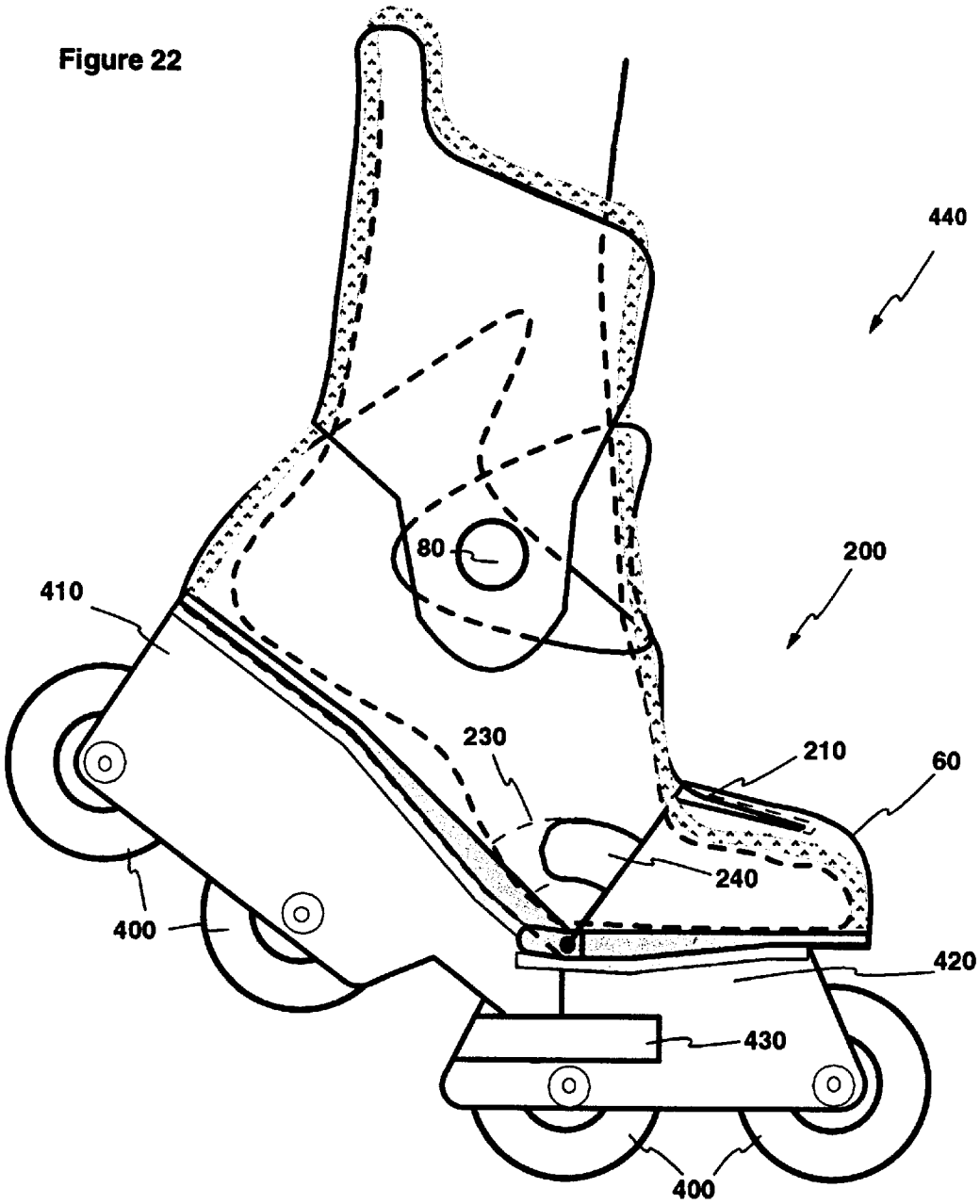

While the present invention is described in ice skate embodiments, it is to be understood that the invention may be applied to various designs of skate. For example, the invention may also be used with an in-line skate design or a roller skate design. See FIGS. 20 to 22, which show an in-line skate 440 including wheels 400 and anterior support 420, posterior support 410 and stop 430.

Numerous modifications, variations and adaptations may be made to the particular embodiments of the invention described above without departing from the scope of the invention, which is defined in the claims.

What is claimed is:

1. A skate comprising:

a boot comprising a footbed for supporting the sole of a foot and an upper portion for supporting a lower leg;

the footbed comprising anterior and posterior portions and hinge means therebetween to permit upward pivotal movement of the anterior and posterior portions of the footbed relative to each other between first and second positions; and the upper portion comprising anterior and posterior portions movable relative to each other, the anterior portion of the upper portion of the boot being rigidly attached to the anterior portion of the footbed, and the posterior portion of the upper portion of the boot being rigidly attached to the posterior portion of the footbed; blade means comprising anterior and posterior portions depending rigidly from the anterior and posterior portions of the footbed respectively; and slidably interlocking interfaces between the anterior and posterior portions of the upper portion of the boot to allow biomechanically efficient relative movement, while ensuring adequate support.

2. A skate as defined in claim 1, wherein the hinge means is incorporated into and forms part of the footbed.

3. A skate as defined in claim 1, wherein the hinge means comprises a single hinge.

4. A skate as defined in claim 1, wherein the hinge means is a complex hinge.

5. A skate as defined in claim 4, wherein the hinge means comprises two hinges and a floating link.

6. A skate as defined in claim 1, wherein the location of the hinge means in the footbed is such that the hinge means is posterior to the joint of the ball of the foot of a skater.

7. A skate as defined in claim 1, further comprising connective means comprising a dependent structure for rigidly connecting the anterior and posterior portions of the blade means to the anterior and posterior portions of the footbed respectively, and an alignment means to ensure that the anterior and posterior portions of the blade means move in alignment with each other.

8. A skate as defined in claim 7, further comprising stop means to limit the upward pivotal movement of the anterior and posterior portions of the footbed relative to each other, thereby altering skating leverage.

9. A skate comprising;

a boot comprising a footbed for supporting the sole of a foot and an upper portion for supporting a lower leg:

the upper portion comprising a cuff portion, a heel portion, at least one central portion overlapping both the cuff and heel portions, and hinge means attached to the cuff, heel and central portions to permit backward and forward pivotal movement of the cuff, heel and central portions relative to each other; and slidably interlocking interfaces between the cuff and heel portions to allow biomechically efficient relative movement while ensuring adequate support; and blade means depending rigidly from the footbed.

10. A skate comprising:

a boat comprising a footbed for supporting the sole of a foot and an upper portion for supporting a lower leg:

the footbed comprising anterior and posterior portions and first hinge means therebetween to permit upward pivotal movement of the anterior and posterior portions of the footbed relative to each other between first and second positions;

the upper portion comprising anterior and posterior portions movable relative to each other, the anterior portion of the upper portion of the boot being rigidly attached to the anterior portion of the footbed, and the posterior portion of the boot being rigidly attached to the posterior portion of the footbed:

the posterior portion of the upper portion of the boot comprising a cuff portion, a heel portion, at least one central portion overlapping both the cuff and heel portions, and second hinge means attached to the cuff, heel and central portions to permit backward and forward pivotal movement of the cuff, heel and central portions relative to each other; and slidably interlocking interfaces between the anterior and posterior portions of the upper portion of the boot and between the cuff and heel portions to allow biomechanically efficient relative movement, while ensuring adequate support; and blade means comprising anterior and posterior portions depending rigidly from the anterior and posterior portions of the footbed respectively.

11. A skate as defined in claim 10, wherein the first hinge means is incorporated into and forms part of the footbed.

12. A skate as defined in claim 10, wherein the first hinge means is a single hinge.

13. A skate as defined in claim 10, wherein the first hinge means is a complex hinge.

14. A skate as defined in claim 13, wherein the first hinge means comprises two hinges and a floating link.

15. A skate as defined in claim 10, wherein the location of the first hinge means in the first footbed is such that the hinge means is posterior to the joint of the ball of the foot of a skater.

16. A skate as defined in claim 10, further comprising connective means comprising a dependent structure for rigidly connecting the anterior and posterior portions of the blade means to the anterior and posterior portions of the footbed respectively, and an alignment means to ensure that the anterior and posterior portions of the blade means move in alignment with each other.

17. A skate as defined in claim 16, further comprising stop means to limit the upward pivotal movement of the anterior and posterior portions of the footbed relative to each other, thereby altering skating leverage.

* * * * *

UNITED STATES PATENT AND TRADEMARK OFFICE

CERTIFICATE OF CORRECTION

PATENT NO. : 6,217,036 B1
DATED : April 17, 2001
INVENTOR(S) : Darrel Rowledge

It is certified that error appears in the above-identified patent and that said Letters Patent is hereby corrected as shown below:

Title page,
ABSTRACT,
Lines 7, 8, "a blade" should be -- blade means --;
Line 9, after "blade" insert -- means --;

Column 4,
Line 65, "of" (second occurrence) should be -- or --;

Column 5,
Line 13, after "notch 105" insert -- and upwardly extending fingers 106 --;
Lines 14, 15, after "105" delete -- and upwardly extending fingers 106 --;
Lines 66, after "illustrate" insert -- how --;

Column 6,
Line 28, "attached" should be -- attach --;

Column 8, claim 9,
Line 25, "biomechically" should be -- biomechanically --;

Column 8, claim 10,
Line 29, "boat" should be -- boot --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,217,036 B1
DATED : April 17, 2001
INVENTOR(S) : Darrel Rowledge

It is certified that error appears in the above-identified patent and that said Letters Patent is hereby corrected as shown below:

Column 8, claim 15,
Line 67, Application Amendment dated 9/25/00,
page 3, reference to Claim 17, line 2,
after "the" (second occurrence in-patent) delete "first"; and Application page 23, line 2, claim 17,
After "the" (third occurrence in patent and application)
insert -- first --.

Signed and Sealed this

Twelfth Day of March, 2002

*Attest:*

*Attesting Officer*

JAMES E. ROGAN
*Director of the United States Patent and Trademark Office*